US006674247B1

(12) United States Patent
Mead et al.

(10) Patent No.: US 6,674,247 B1
(45) Date of Patent: Jan. 6, 2004

(54) EFFICIENT PHOTOGRAPHIC FLASH

(75) Inventors: Carver A. Mead, Santa Clara, CA (US); Glenn J. Keller, Santa Cruz, CA (US)

(73) Assignee: Foveon, Inc., Santa Clara, CA (US)

( * ) Notice: Subject to any disclaimer, the term of this patent is extended or adjusted under 35 U.S.C. 154(b) by 2 days.

(21) Appl. No.: 10/032,583

(22) Filed: Dec. 20, 2001

(51) Int. Cl.[7] ..... H05B 37/00

(52) U.S. Cl. ..... 315/241 P; 315/241 S; 315/200 A

(58) Field of Search ..... 315/241 P, 341 S, 315/241 R, 151, 166, 200 A

(56) References Cited

U.S. PATENT DOCUMENTS

| | | | |
|---|---|---|---|
| 3,821,635 A | 6/1974 | Kimmel et al. | 323/102 |
| 3,947,720 A | 3/1976 | Breitkreuz | 315/151 |
| 4,007,398 A | 2/1977 | Nakamura et al. | 315/151 |
| 4,012,665 A | 3/1977 | Nakamura et al. | 315/241 |
| 4,027,199 A | 5/1977 | Johnson | 315/241 |
| 4,070,699 A | 1/1978 | Einbinder | 361/86 |
| 4,071,808 A | 1/1978 | Zentmyer | 315/241 |
| 4,075,536 A | 2/1978 | Stevens | 315/241 |

(List continued on next page.)

OTHER PUBLICATIONS

Dixon, Lloyd H., "Magnetic Field Evaluation in Transformers and Inductors", Power Supply Design Seminar, 2001 Series, Unitrode Products from Texas Instruments.

Dixon, Lloyd H., "Magnetics Design for Switching Power Supplies, Section 1–Introduction and Basic Magnetics", Texas Instruments Online Training Course Description, 2001.

McLayman, Colonel Wm. T., *Transformer and Inductor Design Handbook*, 2[nd] Edition, 1988.

Don's Xenon Flash and Strobe Page, at http://ww.misty.com/people/don/donflash.html, 2001.

Ferroxcube, "Leading the ferrite technology" at http//www.ferroxcube.com/main.html, Ferroxcube International B.V., 2000.

Halogen Lamps, Xenon Lamps, H.I.D./Metal Haltide Lamps, and More–Amglo Kemlite Lab, "Amglo Kemlite Laboratories, Inc. Leadership in Electronic Gas Dynamics Since 1935" at http://www.amglo.com, 2001.

*Primary Examiner*—Hoang V. Nguyen
(74) *Attorney, Agent, or Firm*—Sierra Patent Group, Ltd.

(57) ABSTRACT

Photographic flashes use the major portion of available energy in modern cameras. A series of innovations within a photographic flash system improves the energy efficiency by a factor of 3, and thereby extends battery life. The flash system includes a precise flash-termination circuit, a high-efficiency charging circuit, a low-leakage coupled inductor, and a battery-saving charge-circuit drive.

Flash termination is controlled by a majority-carrier switching device. This circuit allows termination of the flash current without the timing uncertainty or parasitic leakage associated with previous designs. Multiple flashes also can be produced by the circuit, which may be interfaced with through-the-lens flash controls.

A flyback-converter charging circuit uses a coupled inductor that has an alternately layered winding pattern to lower leakage inductance drastically, and uses appropriately selected wire types to decrease skin-effect resistance losses. Because of the low leakage inductance, the charge circuit can make use of simple energy-efficient overshoot-damping circuitry. The charge circuit also increases battery life by smoothing peaks in current drawn from the battery.

A new drive circuit operates the flyback converter efficiently, maintains battery current below a damage-threshold level to extend battery life, and efficiently holds the flash capacitor in a maximum charge state.

39 Claims, 28 Drawing Sheets

U.S. PATENT DOCUMENTS

| | | | | | |
|---|---|---|---|---|---|
| 4,091,308 | A | | 5/1978 | Schneider | 315/151 |
| 4,132,923 | A | | 1/1979 | Gahler et al. | 315/151 |
| 4,155,031 | A | | 5/1979 | Kuraishi | 315/241 |
| 4,179,728 | A | | 12/1979 | Pirkle | 363/59 |
| 4,272,806 | A | | 6/1981 | Metzger | 363/21 |
| 4,285,588 | A | | 8/1981 | Mir | 354/137 |
| 4,305,649 | A | | 12/1981 | Nagaoka et al. | 354/139 |
| 4,385,347 | A | * | 5/1983 | Takematsu | 363/49 |
| 4,486,691 | A | * | 12/1984 | Beggs | 314/241 P |
| 4,522,479 | A | | 6/1985 | Yamada et al. | 354/413 |
| 4,717,861 | A | | 1/1988 | Yuasa et al. | 31/241 |
| 5,004,958 | A | * | 4/1991 | Hirata | 315/241 P |
| 5,027,039 | A | | 6/1991 | Matsui et al. | 315/241 |
| 5,130,738 | A | | 7/1992 | Hirata | 354/416 |
| 5,196,766 | A | * | 3/1993 | Beggs | 315/241 P |
| 5,282,120 | A | | 1/1994 | Kijima | 363/21 |
| 5,430,405 | A | | 7/1995 | Cohen | 327/581 |
| 5,443,999 | A | | 8/1995 | Uenishi et al. | 437/6 |
| 5,485,361 | A | | 1/1996 | Sokal | 363/21 |
| 5,498,951 | A | | 3/1996 | Okamura et al. | 322/2 |
| 5,532,555 | A | | 7/1996 | Yamada | 315/241 |
| 5,640,620 | A | | 6/1997 | Matsui | 396/156 |
| 5,717,962 | A | | 2/1998 | Sasaki et al. | 396/156 |
| 5,752,102 | A | | 5/1998 | Matsui et al. | 396/156 |
| 5,780,976 | A | | 7/1998 | Matsuo | 315/241 |
| 5,781,804 | A | | 7/1998 | Constable | 396/6 |
| 5,814,948 | A | | 9/1998 | Teremy | 315/241 |
| 5,869,936 | A | | 2/1999 | Horinishi et al. | 315/241 |
| 5,880,943 | A | | 3/1999 | Yokoyama | 363/56 |
| 5,966,552 | A | | 10/1999 | Hata | 396/206 |
| 5,990,631 | A | | 11/1999 | Hioki et al. | 315/241 |
| 6,011,359 | A | * | 1/2000 | Days | 315/241 P |
| 6,066,926 | A | | 5/2000 | Yamada | 315/241 |
| 6,069,803 | A | | 5/2000 | Cross | 363/21 |
| 6,091,906 | A | | 7/2000 | Hata | 396/206 |
| 6,130,528 | A | | 10/2000 | Aoyama | 323/282 |
| 6,147,460 | A | | 11/2000 | Ichihara | 315/241 |
| 6,150,770 | A | | 11/2000 | Hirata et al. | 315/241 |
| 6,219,493 | B1 | | 4/2001 | Aoki et al. | 396/206 |
| 6,289,180 | B1 | * | 9/2001 | Jeng | 396/206 |

* cited by examiner

EFFICIENT PHOTOGRAPHIC FLASH

CROSS-REFERENCE TO RELATED APPLICATION

Co-pending application 09/515807, High-Sensitivity Storage Pixel Sensor Having Auto-Exposure Detection, assigned to Foveon, Inc., is incorporated by reference.

BACKGROUND

1. Field of the Invention

Embodiments relate to the field of photographic flashes and in particular to efficient flash termination and charging.

2. Related Art

Photographic flashes use a high percentage of the battery power available to modem cameras. Despite the level of commercial interest in photography, electronic flashes remain highly inefficient. In a typical flash, only 30 percent of the energy drained from the battery reaches the flash capacitor.

FIG. 1 is a schematic diagram of a typical flash system. Capacitor 114 is charged from battery 108 by charge circuit 116. To make a flash, controller 121 closes switch 120 and sends trigger signal 119 to cause trigger circuit 118 to send a pulse through electrode 112 of flash tube 110. Trigger signal 119 partially ionizes the gas in flash tube 110; capacitor 114 then discharges through the gas, causing a flash of light energy to be radiated. The flash stops when the voltage on capacitor 114 falls below a threshold or switch 120 is opened.

Prior-art photo flashes use minority-carrier semiconductor switching devices, also known as conductivity-modulated devices or bipolar devices, as switch 120. Use of such devices incurs problems with timing uncertainty and parasitic power losses, due to a turn-off delay, of typically many microseconds, that depends on minority carrier storage and recombination times. Some of these flash systems emit multiple flashes of light for one picture; however, timing uncertainty lowers performance or renders the circuits complex.

FIG. 2 is a schematic diagram of flyback converter charge circuit 200, typical in photographic flashes. FIG. 3 is a timing diagram. Current flows through primary winding 242 of coupled inductor 241 when drive circuit 244 turns on transistor 246, completing a circuit through primary 242 from battery 108. Transistor gate voltage and primary voltage are shown by traces 301 and 302, respectively, in FIG. 3; trace 303 shows the drain voltage of transistor 246. When drive circuit 244 turns off transistor 246, mutual inductance generates current in secondary winding 243. Voltage across secondary 243 is shown by trace 304 in FIG. 3. Diode 248 allows current to flow from secondary 243 into capacitor 114, and not back out. Thus, the circuit charges capacitor 114 over many cycles.

Typical flyback converters have inefficient coupled inductors that waste power, and that can create overshoot voltages at transistor 246, potentially damaging it. Also, the current drained from battery 108 may have steep spikes and dips, lowering battery life.

FIGS. 4A and 4B are cross-section illustrations of the winding of a typical coupled inductor. Primary winding 242 is wound around plastic bobbin 460; then, insulation 468 is placed over winding 242; finally, layers of secondary winding 243 are wound over insulation 468. Ferrite core 250 with axis 464 is made in two halves, 455 and 456. Plastic bobbin 460 supports windings 242 and 243, shown with an "X."

Typical coupled inductors suffer from primary-winding leakage inductance and skin effect. Leakage inductance is caused by poor magnetic-field coupling between primary winding 242 and secondary winding 243. Primary leakage inductance causes overshoot voltages that can damage switching transistor 246. Skin effect causes energy losses by increasing the impedance of the windings at high frequencies. Skin effect dominates the resistive losses in primary windings that are made from thick wire.

Many coupled inductors are wound on iron cores, rather than on core materials that do not easily saturate. Such an inductor reaches saturation while the current in the primary winding is still increasing, and wastes energy that cannot be stored in the core's magnetic field.

FIG. 5 is taken from FIG. 5 of U.S. Pat. No. 5,430,405, a schematic diagram of a coupled-inductor charging circuit and driver. A typical problem with such circuits is that, as capacitor 114 approaches higher charge voltages, the cyclical action of circuit 500 speeds up to drive higher voltage into capacitor 114, causing the current drained from battery 108 to increase beyond a limit where the battery may be damaged, and thus shortening battery life.

Thus, it would be desirable to have a flash system that saves battery energy, extends battery life, and enhances flash performance by controlling flash timing accurately, with little energy loss, and by including a charge circuit with an efficient coupled inductor that also limits overshoot voltages and battery-current spikes, and that has a switching rate controlled by a drive circuit that limits the amount of current drained from the battery and uses energy-efficient components.

A more detailed background of related flash and charge circuits is included in Appendix A.

SUMMARY OF THE INVENTION

In accordance with the present invention, energy efficiency of a photographic flash is improved by provision of several unique circuits that significantly increase the efficiency of the flash. Efficiency, measured by energy stored on the flash capacitor divided by energy drained from the battery, is conserved by precisely timed flash termination, a low-loss flyback converter, a high-efficiency coupled inductor, and a battery-saving charge circuit, including a new drive. When the several improvements are combined, total energy efficiency is improved from a nominal 30-percent efficiency to close to 90-percent efficiency.

In some embodiments, a majority-carrier switching-device circuit controls flash termination, starting and stopping the flow of current from the flash capacitor through the flash tube. This circuit eliminates the problems of timing uncertainty and transient energy dissipation, which are associated with previous designs, thereby making possible more precisely timed flashes, including multiple flashes. Thus, energy is not wasted by being dumped from the flash capacitor or in transient energy dissipation. The disclosed flash-control method may also be used in conjunction with a through-the-lens (TTL) exposure control that determines how much flash energy is needed for capture of a given image, and that commands the flash control to deliver only that much flash energy, thereby further saving energy.

Some embodiments use a high-efficiency coupled inductor to save energy during charging of the flash. This coupled inductor makes use of both an overlapping winding configuration and multiple primary winding strands. Multiple primary strands lower energy losses caused by skin effects. The winding configuration enables the primary and secondary windings to share the magnetic field of the core more efficiently, thus lowering primary leakage inductance, which is another source of energy loss. Lower primary leakage inductance also results in smaller voltage spikes during turn-off of the primary winding.

A charge circuit that uses the high-efficiency inductor does not require an active snubber to damp voltage spikes. Omitting the snubber circuitry saves energy. Several embodiments of such an energy-saving charge circuit are disclosed; each has simple and efficient damping circuits that control effectively the reduced overshoot voltages and that smooth battery current drain. Because overshoot voltages are controlled, the field-effect transistor (FET), which is used to drive the charge circuit, can also be small and energy efficient. The circuit extends battery life by smoothing out peaks in the battery-current drain.

Some embodiments of the present invention include a new drive circuit that keeps battery-current drain below a threshold value, thus further extending battery life. Some embodiments of the drive circuit save additional energy by using discrete transistor circuits rather than operational amplifiers.

By combining several novel circuits and devices, the various embodiments of the resent invention improve overall energy efficiency.

DETAILED DESCRIPTION a. Dynamics of the Discharge

As a step to explaining how flash discharge timing and battery life can be controlled, the following discussion sets forth an accurate model of flash discharge. Discharge current and voltage are modeled according to Equation 1, where I is flash current, V is capacitor voltage, $V_{min}$ is the voltage at which the flash extinguishes, and k and n are parameters of the specific flash tube.

$$I=k(V-V_{min})^n \quad [1]$$

Figure 6:
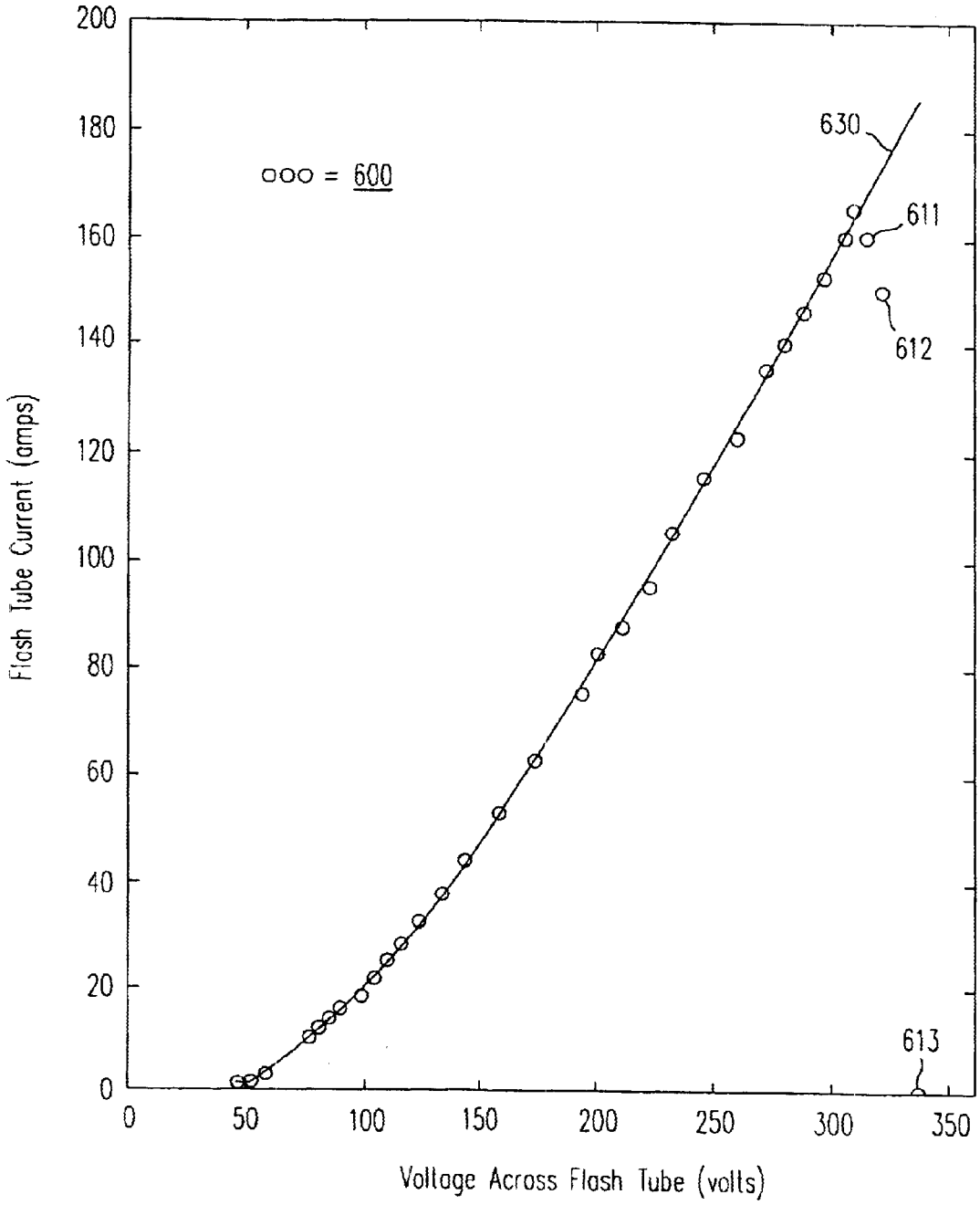
FIG. 6 is a graph comparing theoretical and measured discharge parameters.

FIG. 6 is a graph of theoretical and measured current-voltage curves for flash discharge. Data were measured for the case of an Amglo MFT118 flash tube. In this example, fitting measured data to Equation 1 determined that k was 0.101 A/V, $V_{min}$ was 45 V, and n was 1.325. Measured data are plotted as points 600. Curve 630 represents a prediction based on Equation 1. This prediction shows a good fit to measured current-voltage points 600. The good fit is at least partly due to accounting for voltage $V_{min}$, at which the discharge extinguishes spontaneously.

In a basic flash circuit, current I is given by Equation 1, $V_{min}$ is a constant, and $V_0$ is the initial capacitor charge voltage. Because $V_{min}$ is a constant, d(V) is equal to d(V−$V_{min}$). Equation 2, which defines the behavior of the capacitor, leads to a differential equation for the dynamic behavior of a flash discharge, given by Equation 3.

$$I = -C\frac{dV}{dt} \quad [2]$$

$$-C\frac{d(V - V_{\min})}{dt} = k(V - V_{\min})^n \quad [3]$$

The solution for V is given in Equation 4:

$$V - V_{\min} = \left(\frac{C\alpha}{kt_0}\right)^{\alpha} \left(1 + \frac{t}{t_0}\right)^{-\alpha} \quad [4]$$

$$\text{where } \alpha = \frac{1}{n-1} \quad \text{and} \quad t_0 = \frac{C\alpha}{k(V_0 - V_{\min})^{n-1}}$$

Figure 7:
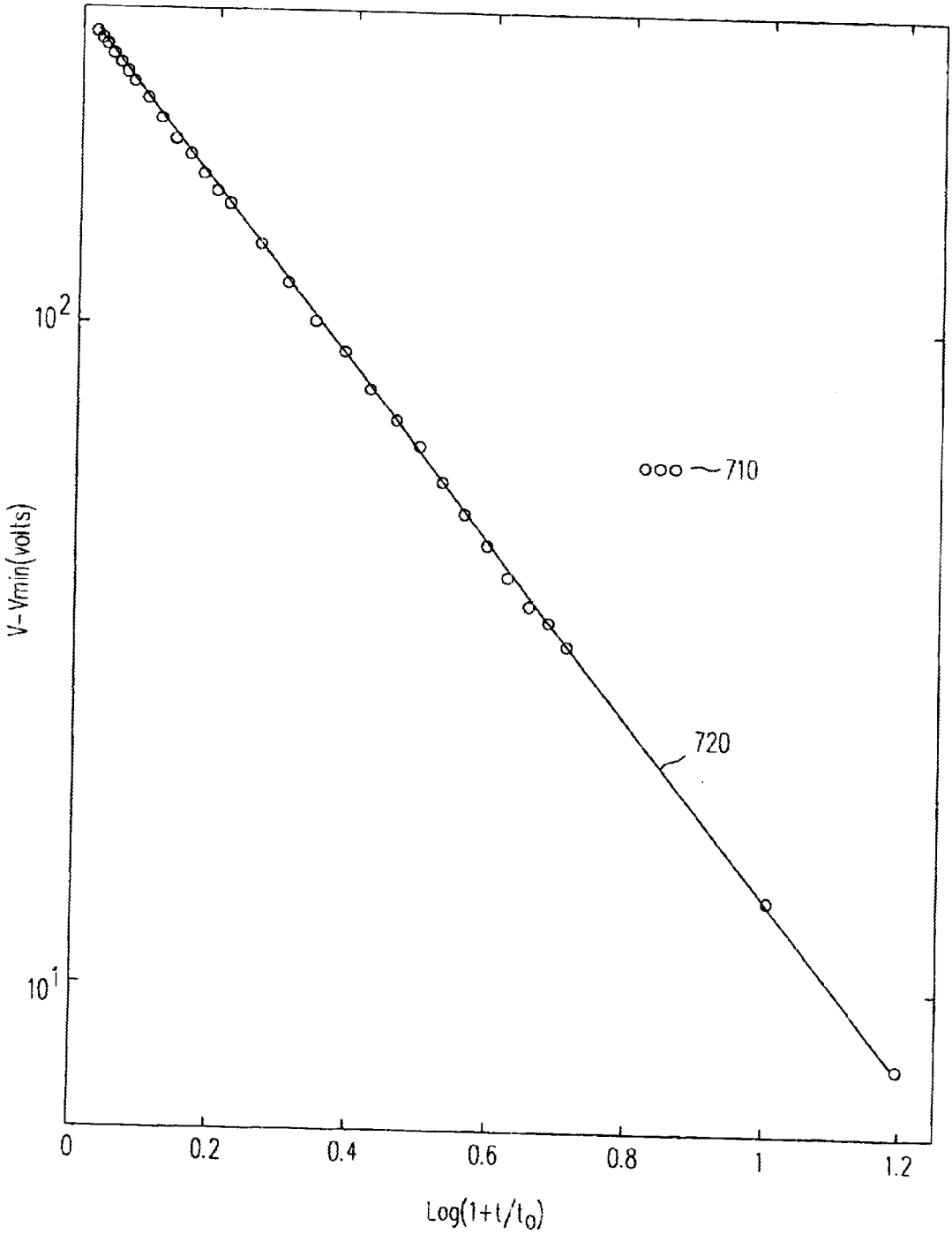
FIG. 7 is a graph of predicted and measured flash-discharge voltage.

FIG. 7 is a graph of predicted and measured discharge voltage. The expression of Equation 4 is plotted as curve 720, along with measured discharge data, as points 710. There are no adjustable parameters in this plot and there is agreement between experiment and theory. As the capacitor voltage approaches $V_{min}$, the discharge becomes marginal, and spontaneously extinguishes randomly. For that reason, the voltage remaining on capacitor 114 after discharge is typically higher than $V_{min}$, and varies from flash to flash by an amount on the order of volts.

The slight drop in measured data points 710 below theoretical curve 720 just after ignition is due to internal resistance of capacitor 114. In the case where a Cornell Dubilier 7P152V360A062L capacitor was used, the voltage drop at a peak current of 165 A was 5 V, indicating a resistance of 0.03Ω. Less than 1.5% of the energy in capacitor 114 was therefore dissipated in series resistance. The 7P152V360A062L is marketed as a special-purpose photoflash capacitor, based on its having high energy-storage density and low effective series resistance. A common electrolytic capacitor with the same value of capacitance would typically have a much higher effective series resistance, and thus would be unsuitable for use in photoflash applications.

Equation 5 is an expression for flash current as a function of time, obtained using the voltage from Equation 4 in the current-voltage relation given in Equation 1.

$$I = k\left(\frac{C\alpha}{kt_0}\right)^{n\alpha} \left(1 + \frac{t}{t_0}\right)^{-n\alpha} \quad [5]$$

Figure 8:
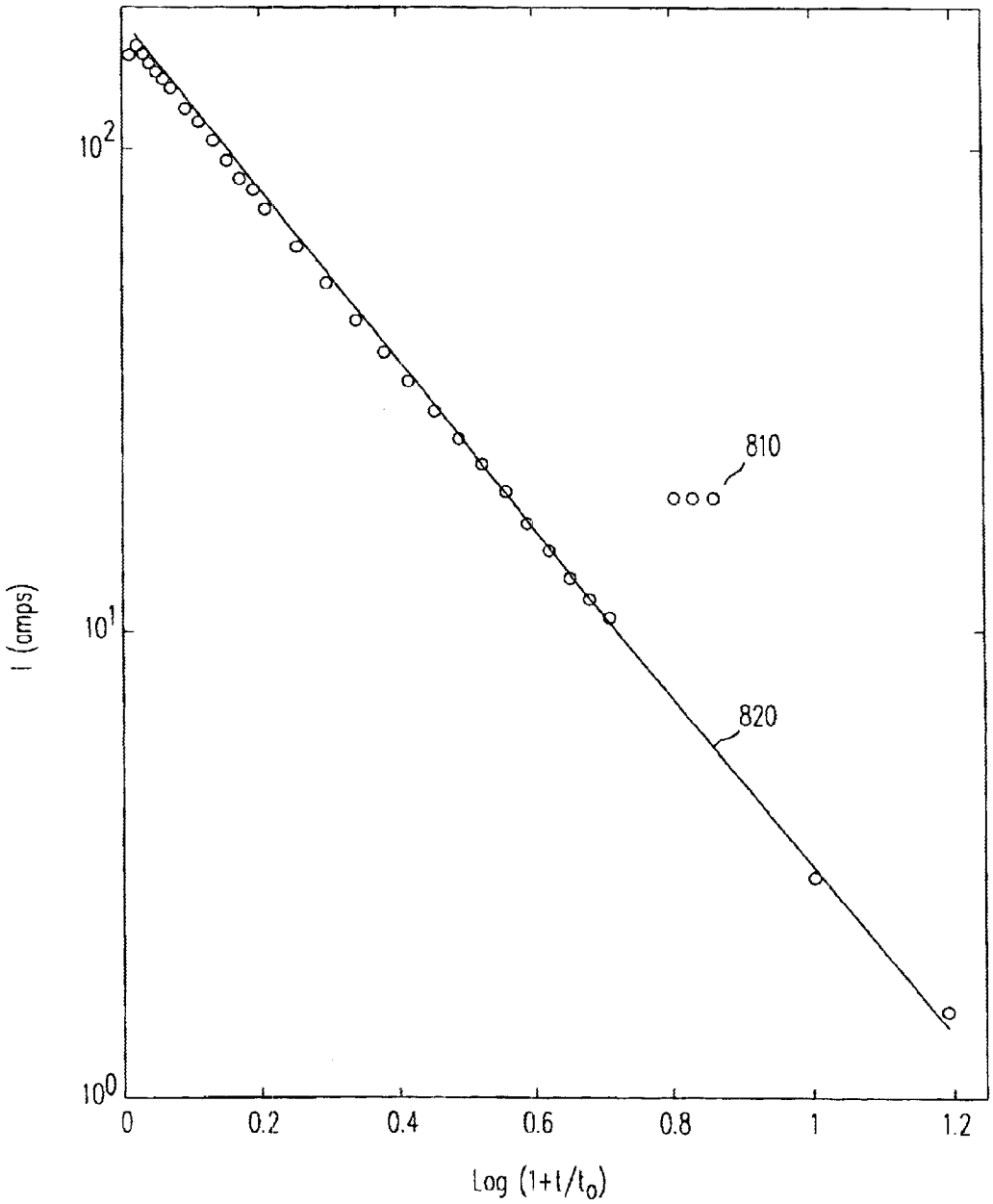
FIG. 8 is a graph of predicted and measured flash-discharge current.

FIG. 8 is a graph of predicted and measured discharge current. Current I, shown as curve 820, was predicted by Equation 5. Measured data are shown as points 810. There are no adjustable parameters in Equation 5, and there is agreement between measurements and prediction. The slight misfit at the first few of points 810, early in the discharge when the current is highest, are due to the series resistance of capacitor 114, which has been neglected in the model equations.

In conclusion, an improvement in modeling flash dynamics is accomplished by manipulation of Equation 1, which expresses the measured characteristics. This approach leads to accurate voltage and current expressions, which may be expressed in the form of power-law functions of $(1+t/t_0)$.

b. Energy in the Flash

Multiplying the expression for current in Equation 5 by the expression for voltage in Equation 4, gives the instantaneous power P delivered to the discharge at time t, as expressed by Equation 6.

$$P = k\left(\frac{C}{k(n-1)t_0}\right)^{\beta}\left(1 + \frac{t}{t_0}\right)^{-\beta} + kV_{\min}\left(\frac{C}{k(n-1)t_0}\right)^{\gamma}\left(1 + \frac{t}{t_0}\right)^{-\gamma} \quad [6]$$

where $$\beta = \frac{n+1}{n-1} \quad \text{and} \quad \gamma = \frac{n}{n-1}$$

Power P is the sum of two steep power-law functions of $1+t/t_0$. For the flash tube used in this example, n is 1.325, so β is 7.15 and I is 4.08 A. For short times, the second term in Equation 6 makes a negligible contribution to the magnitude of the power, but serves to flatten the curve. Most of the useful energy in the flash is emitted in the early part of the discharge; therefore, Equation 7 is a convenient approximation for P.

$$P \approx P_0\left(1 + \frac{t}{t_0}\right)^{-m} \quad [7]$$

In the case of the Cornell Dubilier 7P152V360A062L capacitor, m is 6.15, or somewhat less than the exponents β of the first term in Equation 6. $P_0$ is the extrapolated initial peak power delivered to the discharge.

Figure 9:
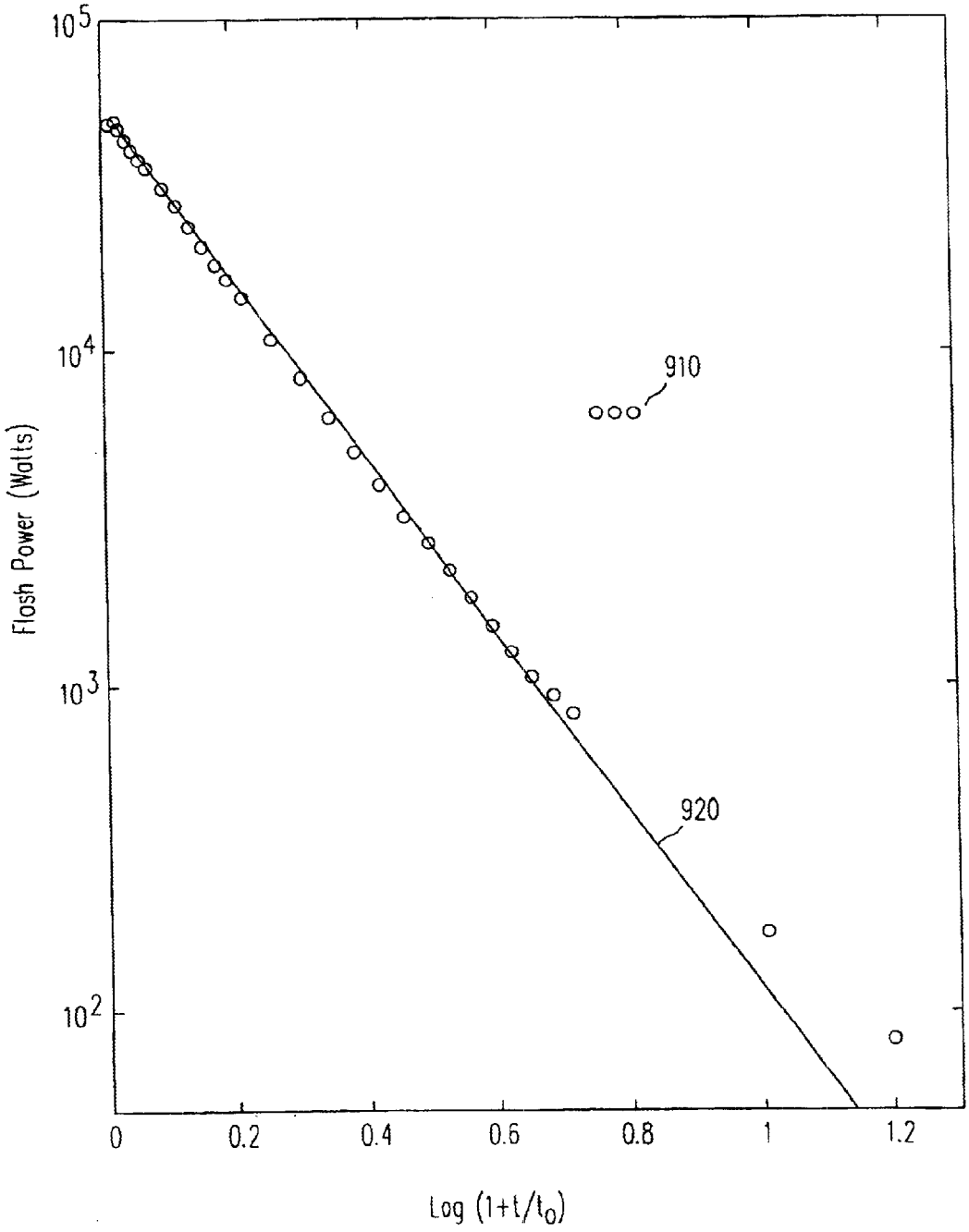
FIG. 9 is a graph of predicted and measured flash-discharge power.

FIG. 9 is a graph of both predicted and measured power of a flash discharge. Power was calculated according to Equation 7 and is shown as curve 920. Measured data are plotted as points 910. The fit is imperfect, due to the approximation; however, Equation 7 provides a simple form that agrees with measured data over a factor of 50 in power.

The approximation for power given by Equation 7 is used to derive an expression for the total energy W delivered to the discharge as a function of time. Integration of Equation 7 gives Equation 8:

$$W \approx \frac{P_0 t_0}{m-1}\left[1 - \left(1 + \frac{t}{t_0}\right)^{-(m-1)}\right] \quad [8]$$

Figure 10:
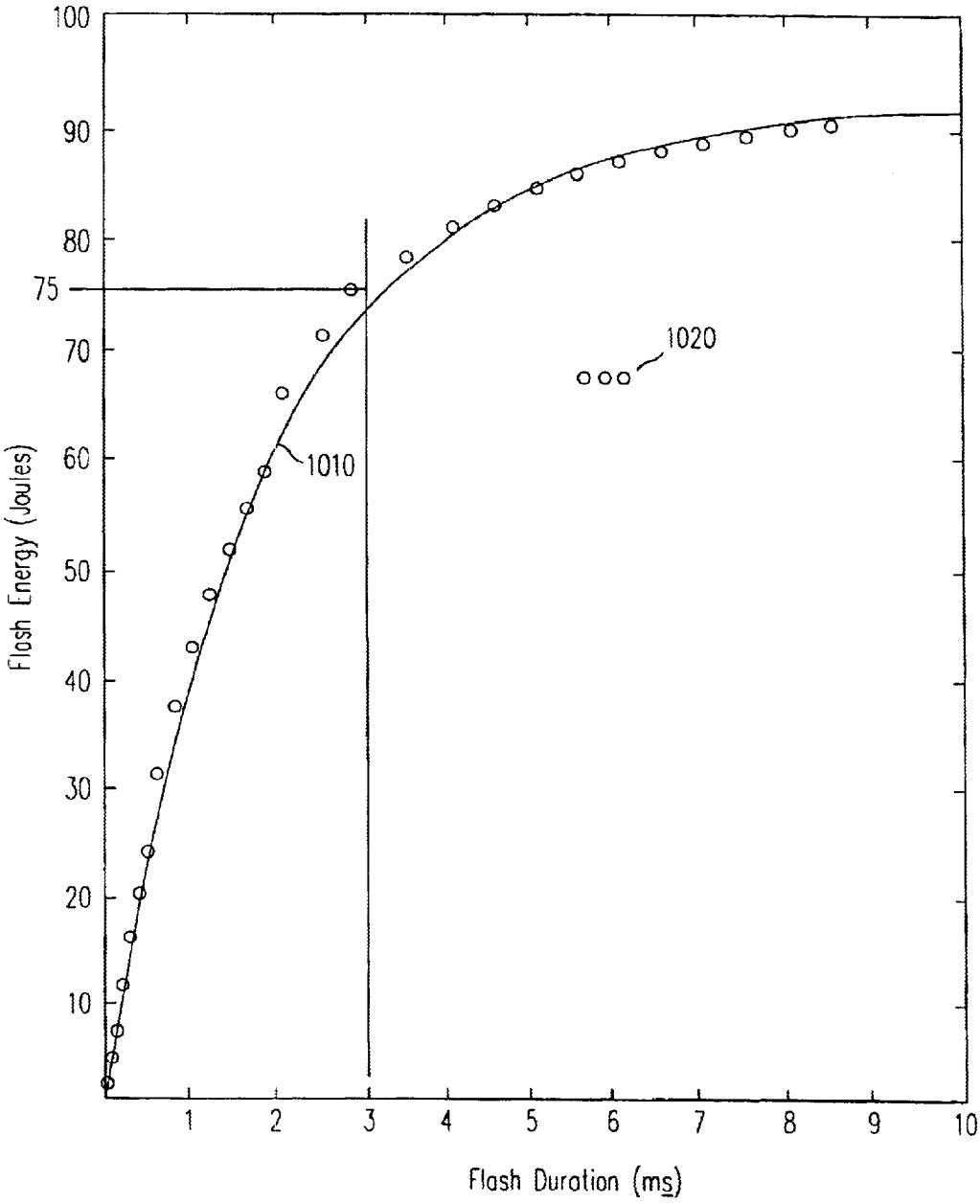
FIG. 10 is a graph of predicted and measured flash-discharge energy.

FIG. 10 is a graph of both predicted and measured total energy available for the flash. Equation 8 expresses total energy W delivered to the flash discharge, for a discharge current that is terminated at time t. Predicted data are shown as curve 1010; measured data are shown as points 1020.

c. Control of the Flash Energy

With no controls, flash discharge spontaneously extinguishes after the capacitor voltage has decreased to near $V_{min}$. However, light output from a photoflash can be controlled either by switching different capacitor sizes, by setting the initial capacitor voltage, or by truncating the discharge time.

The energy stored in a capacitance C charged to a voltage V is given by $C V^2/2$. The flash discharge can be controlled by setting capacitor voltage V prior to triggering the flash. This method is used in studio flash units, with which test photographs are typically the basis for adjustments in lighting and exposure. For photography under field conditions, test exposures may be difficult to obtain, so flash control based on measuring light during the actual exposure is preferable.

Real-time metering gives an estimate of the state of exposure of the image when the exposure is taken. Through-the-lens (TTL) metering can aid in use of flash systems under wide varieties of unpredictable conditions. TTL metering output is available during exposure, and the flash may be terminated when the TTL meter indicates that full exposure has been achieved. As an example TTL metering embodiment, co-pending application Ser. No. 09/515807, High Sensitivity Storage Pixel Sensor Having Auto-Exposure Detection, assigned to Foveon, Inc., incorporated by reference, discloses an auto-exposure circuit that produces a terminate-exposure signal from a solid-state image sensor.

FIG. 10 shows that over 75 percent of flash energy is released in about the first 3 ms of a flash. Therefore, the most precise control of discharge termination is needed over a specific few milliseconds. Such precise timing is especially desirable when a TTL or other real-time exposure control is used.

d. Flash Termination

Figure 11:
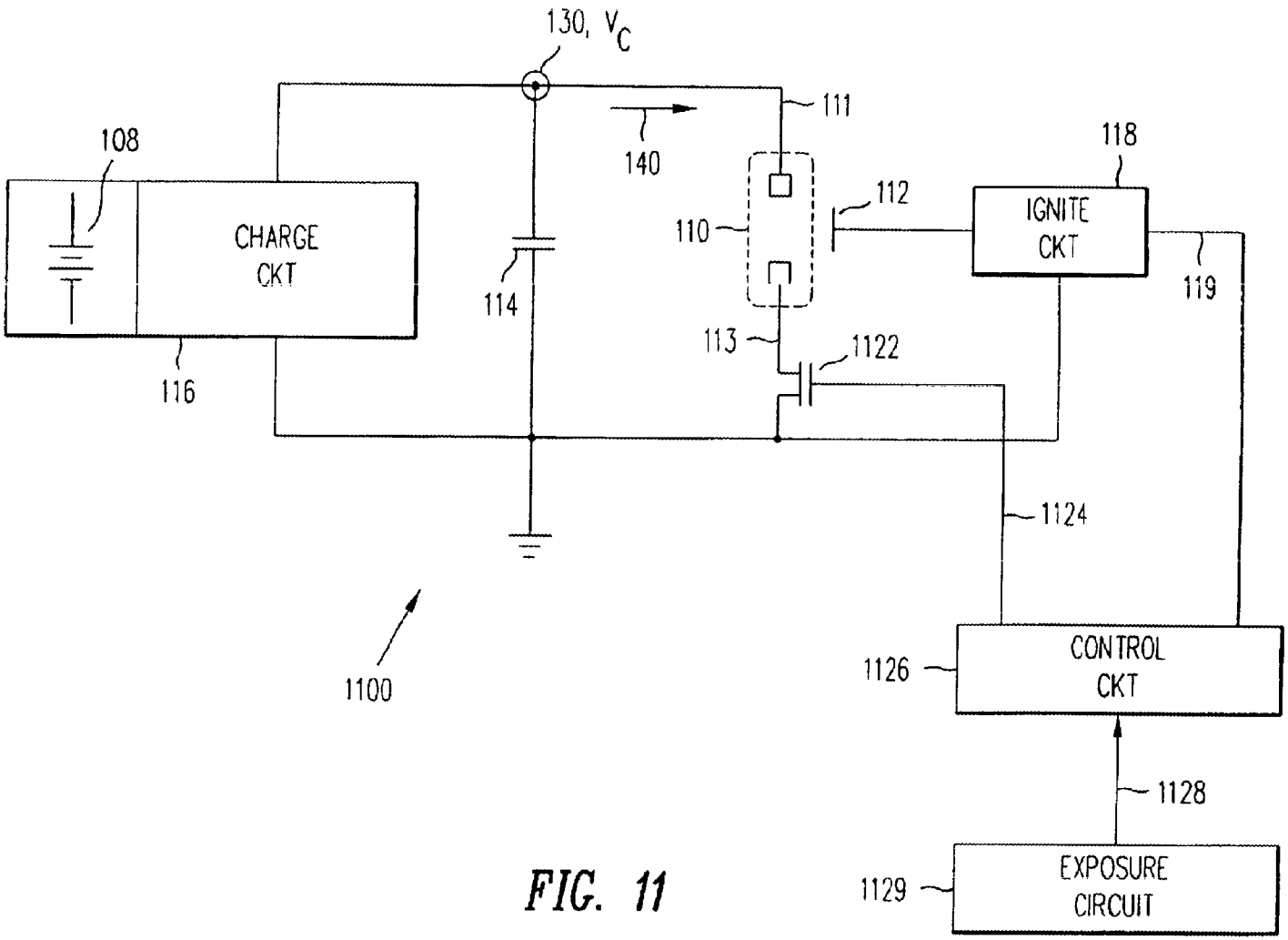
FIG. 11 is a schematic diagram of a flash-discharge circuit according to the present invention.

FIG. 11 is a schematic diagram of an embodiment of a flash-control circuit according to the present invention. Circuit 1100 comprises MOS semiconductor switching device 1122, and timing-control circuit 1126. MOS power-switching transistors can switch high currents at high voltages with very short turn-on and turn-off times.

Some embodiments of the present invention make use of MOS power-switching transistor APT50M50JVR, supplied by Advanced Power Technology. The APT50M50JVR has a measured on resistance of 0.04Ω, a rated voltage of 500 V, a turn-on time of 20 ns, and a turn-off time of 12 ns. In some embodiments of the present invention, gate voltage 1124, used to turn on fully device 1122, may be less than 10 V, and may be generated by a commercial timing circuit.

Used in circuit 1100 with an 1800 $\mu$F capacitor charged to 350 V, the APT50M50JVR has a voltage drop of 6.5 V at the peak of the discharge, and therefore dissipates less than 2 percent of the power in the discharge. The performance of the APT50M50JVR, particularly with respect to turn-off time, is orders of magnitude better than that of most conductivity-modulated devices, because the APT50M50JVR does not exhibit minority-carrier storage effects.

Figure 12:
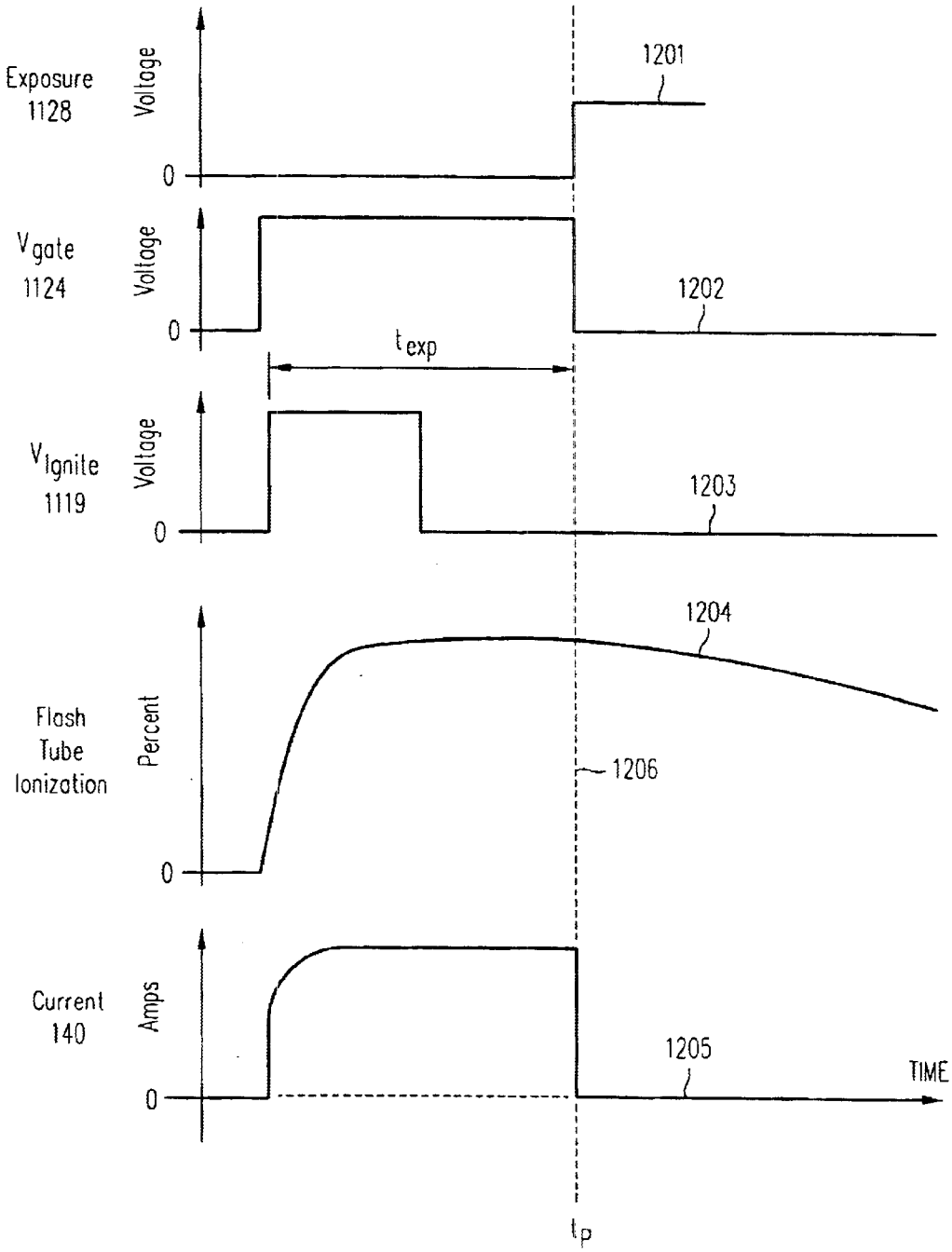
FIG. 12 is a timing diagram for flash termination.

FIG. 12 is a timing diagram for signals in circuit 1100, where TTL control is used. Trace 1201 represents an exposure signal 1128, where a low level allows a flash and a high level terminates it. Trace 1202 shows the voltage at gate 1124. The gate voltage is held at zero until the flash is about to start, then is raised high (to about +9 V with respect to ground). Trace 1203 shows signal 119, the input to ignite circuit 118, which starts ionization in flash tube 110, initiating the discharge. These signals are supplied by control circuit 1126. The ionization state of the flash tube is shown by trace 1204.

At time $t_p$ shown at 1206, exposure signal 1128, as shown by trace 1201, is set high by the TTL sensing system or by any other means, such as by remote control, timing circuit, or exposure meter. Circuit 1100 may operate with a TTL system such as the image-plane sensing system of co-pending application Ser. No. 09/515807. Upon receiving exposure signal 1128, control circuit 1126 drives to ground gate 1124 of MOS power-switching transistor 1122, interrupting the discharge current shown as trace 1205.

Although the current, shown by trace 1205, drops abruptly to zero at $t_p$, the ionization of the plasma in flash tube 110, shown by trace 1204, decays over a much longer time. In typical photographic flash tubes, full recombination can take tens of milliseconds. For that reason, in a system with timing such as that shown in FIG. 12, gate 1124 is not raised until the ionized gas is fully recombined. Gate 1124 may be raised to its on voltage just before ignite signal 119 is issued, as shown in FIG. 12.

e. Multiple Flashes

Figure 13:
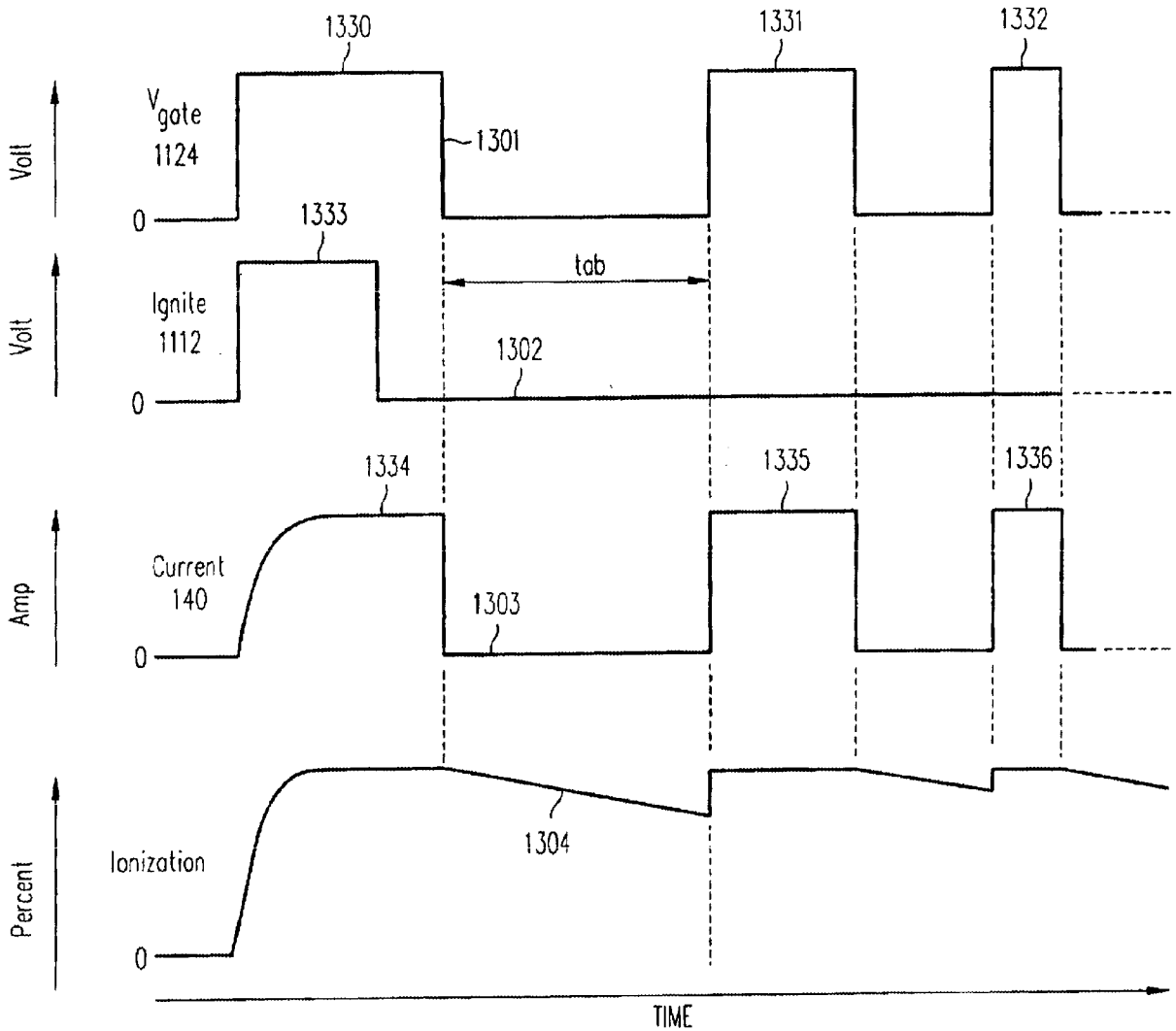
FIG. 13 is a timing diagram for multiple flash generation.

FIG. 13 is a timing diagram of a flash unit that provides multiple flashes. In some embodiments of the present invention, the slow recombination of ions and electrons in tube 110 is used to facilitate generation of a plurality of precisely controlled flashes. The signals to gate 1124 and to ignite circuit 118, shown by timing traces 1301 and 1302, respectively, are provided by control circuit 1126.

Pulse 1330 is issued to gate 1124 along with ignite pulse 1333. During the initial pulse of 1330, the first current pulse 1334 and flash-tube ionization trace 1304 are similar to the corresponding quantities that were shown in FIG. 12. After initial flash pulse 1330 has terminated, the ionization, shown by trace 1304, decays slowly. After time $t_{ab}$, second pulse 1331 is issued by control circuit 1126. Second pulse 1331 turns back on MOS power-switching transistor 1122, and the current in the discharge, shown by trace 1303, rises immediately, because the plasma is already ionized. There is no need to apply another ignite pulse for any flash pulse after the first one, as long as the spacing between the pulses is shorter than the plasma-recombination time.

After the termination of pulse 1331, third current pulse 1332 is generated by issuance of another gate pulse. Multiple pulses can be used to generate multiple flashes. Each pulse may be a different width, as are pulses 1330, 1331, and 1332, as shown in FIG. 13. The width of each pulse can be controlled in duration to within nanoseconds (and therefore the energy of the pulse can be controlled precisely) because of the fast timing characteristics of MOS power-switching transistor 1122. Compared to prior-art circuits, circuit 1100 may control flash durations more precisely, with less energy loss, and with fewer components.

f. Coupled Inductor

Some embodiments of the present invention improve charging efficiency of flyback-converter capacitor charging systems by use of an improved coupled inductor.

A magnetic core that may be used in some embodiments of the present invention is ferrite "pot" core model P-P26/16-3F3-A315 supplied by Ferroxcube (information concerning both the material and the core configuration is available on the web site www.ferroxcube.com). With this core, it is possible to operate a flyback charge circuit according to the present invention at frequencies exceeding 100 kHz, without core loss exceeding 1 percent of the power being converted.

Figure 14A:
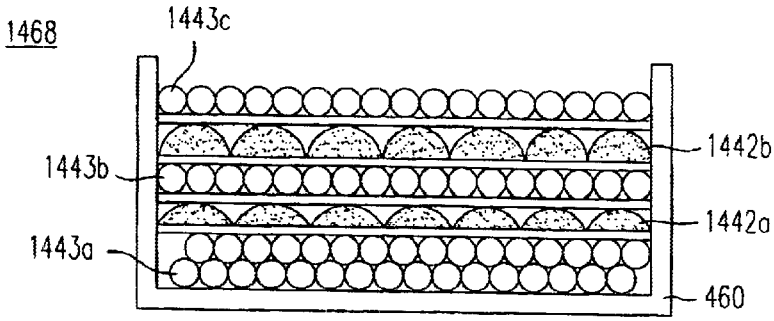
FIG. 14A is a cross-sectional diagram of a coupled inductor winding according to the present invention.
Figure 14B:
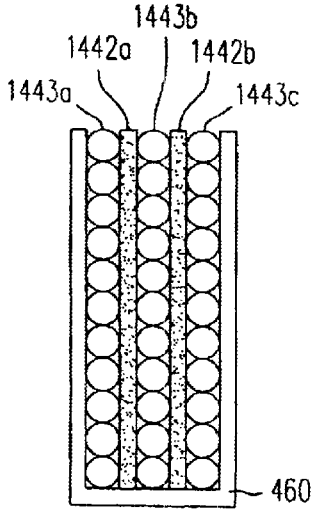
FIG. 14B is a cross-sectional diagram of an embodiment of a coupled inductor winding according to the present invention.

FIGS. 14A and 14B are cross-sectional views of windings 242 and 243 in an embodiment of a coupled inductor according to the present invention. Construction of windings 242 and 243 in alternating layers, as illustrated in FIGS. 14A, B, and C, reduces high-voltage spikes on the primary due to leakage inductance.

Secondary winding 243 is wound in three layers: 1443*a*, 1443*b*, and 1443*c*. Primary winding 242 is wound in two layers: 1442*a* and 1442*b*. These layers are alternated, and may be separated by insulating layers 1468.

So that primary winding 242 has low resistance, it has a large cross-sectional conducting area. In order to minimize skin-effect losses, some embodiments of the present invention achieve a large cross-sectional area by using Litz wire, which is wire made with a large number of small conductors in parallel. Litz wire is available commercially and is used for high-frequency communication coils. When multiple conductors are used, resistance is lowered, but the area-to-volume ratio can be increased, thus decreasing skin effect.

The performance of primary winding 242 benefits from the use of Litz wire because of the large cross-sectional wire area required for low loss at high primary current. A slight further reduction in parasitic resistive loss is achieved if Litz wire also is used for secondary winding 243.

Figure 14C:
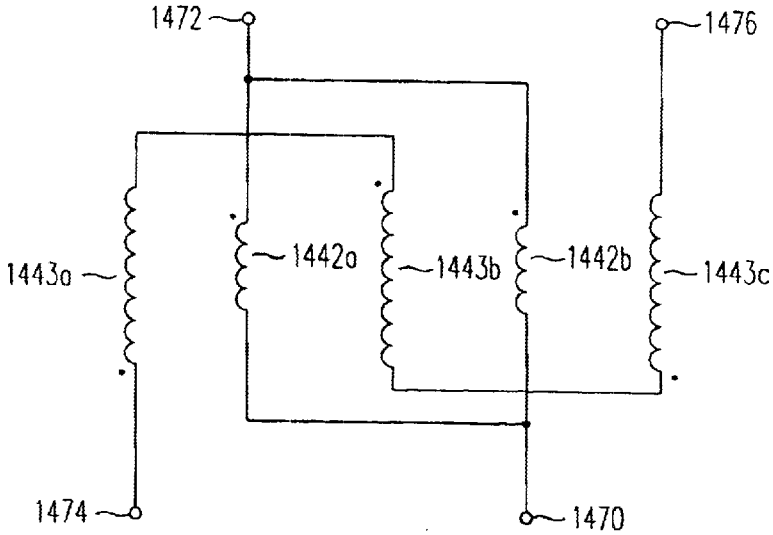
FIG. 14C is a schematic diagram of coupled-inductor winding connections according to the present invention.

FIG. 14C is a schematic diagram of the fields and electrical connections of windings 242 and 243. First primary-winding layer 1442*a* is interposed between layers 1443*a* and 1443*b* of secondary winding 243, and second primary-winding layer 1442*b* is interposed between layers 1443*b* and 1443*c* of secondary 243. The sense of the flux coupling among the layers is indicated by the dots in FIG. 14C.

Secondary layers 1443*a*, 1443*b*, and 1443*c* are connected in series such that their induced voltages add. The input to layer 1443*a* and the output of layer 1443*c* form terminals 1474 and 1476 of composite secondary 243. Primary-winding layers 1442*a* and 1442*b*, the two of which have the same number of turns, are connected in parallel such that their flux couplings are in the same direction. The corresponding common connections form terminals 1470 and 1472 of composite primary winding 242. This configuration increases flux coupling between primary winding 242 and secondary winding 243 because of the interspersed and alternating nature of windings 242 and 243. This embodiment also lowers high-frequency resistive loss because the conductors in the Litz wire of primary winding 242 are connected in parallel.

It is possible to have any number of primary windings alternating with and interspersed between a number s of secondary windings, as long as $s-1 \leqq p \leqq s+1$. In the case p=s+1, primary winding 242 will include top and bottom layers. In the case p=s−1, secondary winding 243 will include top and bottom layers. In the case p=s, a primary-winding layer will lie on the bottom and a secondary-winding layer will lie on the top, or vice versa.

FIGS. 14A, B, and C illustrate an embodiment where p=2 and s=3; however, as just explained, s and p may have other values in other embodiments.

In preferred embodiments of the present invention that have all primary-winding layers connected in parallel, the number of turns in each primary-winding layer is the same. Secondary winding 243, as illustrated in FIG. 14A, may generally have differing numbers of turns in each layer. In the embodiment shown in FIG. 14A, inner secondary-winding layer 1443*a* has more windings than do subsequent layers. If more than one layer of wire is required for the number of turns chosen for a given winding layer, the combination is still counted as one winding layer, as shown in FIG. 14A, where inner winding layer 1443*a* is shown as two layers of wire.

Some embodiments, as shown in FIG. 14A, have multiple winding layers, disposed at successive radii, each at a larger radius than those wound earlier. In other embodiments, each winding layer may be constructed as a disk, and alternating disk-like layers may be stacked next to one another, as shown in FIG. 14B. The embodiment shown in FIG. 14B may be more suitable in the case where core 250 has a radius larger than its width, whereas that shown in FIG. 14A may be more suitable in the case where the radius and width of core 250 are of the same order.

A coupled inductor, according to the present invention, was constructed on a Ferroxcube P-P26/16-3F3-A315 core. Inner secondary-winding layer 1443*a* was wound with 30 turns of #30 insulated magnet wire, followed by first primary-winding layer 1442*a* wound with 7 turns of 245/48 Litz wire, followed by second secondary-winding layer 1443*b* wound with 23 turns of #30 wire, followed by second primary-winding layer 1442*b* wound with 7 turns of 245/48 Litz wire, followed by third secondary-winding layer 1443*c* wound with 23 turns of #30 wire. The first numeral specifying Litz wire is the number of strands, and the second number is the wire gauge of each strand. The layers were separated by thin insulating tape 1468, and were connected electrically as shown in FIG. 14C. The turns ratio for this coupled inductor is N=(30+23+23)/7=11.

The characteristics of the example coupled inductor were measured. Inductance of primary winding 242 with secondary winding 243 open was 16 $\mu$H. Inductance of secondary winding 243 with primary 242 winding open was 1.8 mH. The ratio of inductance was almost the square of turns ratio N, as expected. The primary resistance at 1 kHz was 28 mΩ; that at 100 kHz was 71 mΩ. The primary leakage inductance (primary inductance with secondary 243 shorted) was 0.11 $\mu$H. The parasitic resistance at high frequency was nearly a factor of 2 lower, and the primary leakage inductance was a factor of 5 lower, than corresponding measurements of a coupled inductor built previously in accordance with FIGS. 4A and 4B.

In embodiments of the present invention, the number of primary turns may be chosen based on the battery voltage, core characteristics, operating frequency, and other considerations. Similarly, the number of secondary turns may accommodate maximum capacitor voltage, transistor maximum drain voltage, and other considerations. The details of a particular embodiment are a matter of design choices made by skilled people. The examples given above are for illustrative purposes only, and are not to be read as in any way limiting of the scope of the present invention, which is limited only by the Claims.

g. Charging Circuit

Figure 15A:
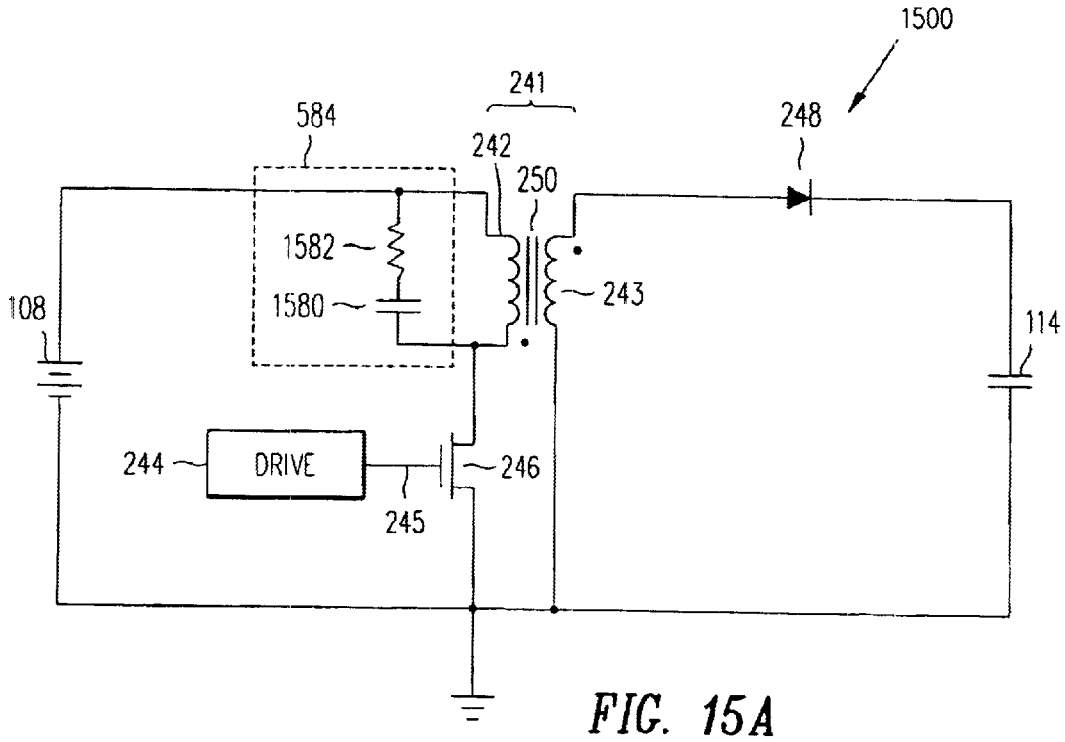
FIG. 15A is a schematic diagram of an embodiment of a flyback converter charge circuit according to the present invention.

FIG. 15A is a schematic diagram of an embodiment of a charging circuit according to the present invention. Circuit 1500 comprises the disclosed coupled inductor of FIGS. 14A, B, and C, as well as damping circuit 1584, comprising damping capacitor 1580 and damping resistor 1582 in a series circuit with primary winding 242. Because of the low leakage inductance of coupled inductor 241, it is possible to reduce voltage spikes that occur when transistor 246 turns off, by using R-C damping circuit 1584 instead of an active snubber circuit.

In some embodiments of the present invention, damping circuit 1584 may be designed according to the following procedure. The energy stored in the primary leakage inductance $L_{leak}$ of coupled inductor 241 is calculated. The energy $E_{leak}$ stored in the leakage inductance at the end of time period $t_1$, when the peak current is $I_p$, is given by Equation 9:

$$E_{leak} = \frac{L_{leak} I_p^2}{2} \qquad [9]$$

The peak drain voltage $V_{dp}$ experienced by transistor 246 is the voltage induced in primary winding 242 when secondary winding 243 is clamped by diode 248 to a maximum value $V_{max}$ of capacitor voltage, plus peak voltage $V_p$ across the leakage inductance as it resonates with damping capacitor 1580, plus battery voltage $V_{bat}$. $V_{dp}$ is given by Equation 10:

$$V_{dp} = \frac{V_{\max}}{N} + V_p + V_{bat} \quad [10]$$

A maximum threshold value of $V_{dp}$ is made equal to the manufacturer's specification on the maximum drain voltage of transistor 246. Given turns ratio N of coupled inductor 241, and the maximum photoflash capacitor voltage $V_{max}$, Equation 11 gives a design value for $V_p$.

$$V_p = V_{dp} - \frac{V_{\max}}{N} - V_{bat} \quad [11]$$

The value $C_d$ of damping capacitor 1580 is chosen such that it just absorbs all the energy in the leakage inductance when $C_d$ is charged to $V_p$, as given by Equation 12:

$$E_{leak} = \frac{L_{leak} I_p^2}{2} = \frac{C_d}{2}\left(\left(V_p + \frac{V_{\max}}{N}\right)^2 - \left(\frac{V_{\max}}{N}\right)^2\right) \quad [12]$$

Equation 12 leads to a value for $C_d$ as given by Equation 13:

$$C_d = \frac{I_p^2 L_{leak}}{\left(V_p + \frac{V_{\max}}{N}\right)^2 - \left(\frac{V_{\max}}{N}\right)^2} \quad [13]$$

The value $R_d$ is then chosen by the critical damping condition expressed in Equation 14:

$$R_d = \sqrt{\frac{L_{leak}}{C_d}} = \frac{1}{I_p}\sqrt{\left(V_p + \frac{V_{\max}}{N}\right)^2 - \left(\frac{V_{\max}}{N}\right)^2} \quad [14]$$

where the second form follows from Equation 13.

Manufacturing tolerances may make it desirable to use a somewhat larger value of $C_d$ to ensure that $V_p$ does not exceed its rated value. The value of $R_d$ may be chosen to be greater or less than that given by Equation 14.

Components and values used to construct an experimental embodiment of Circuit 1500 are given in Table 1. Circuit 1500 used coupled inductor 241 constructed as shown in FIGS. 14A and 14C, and described in the previous section. Battery 108 was a four-cell lithium-ion battery with a nominal voltage of 16 V. The actual voltage of battery 108 (depending on the state of charge) ranged from 18 V to 12 V. The battery current threshold was chosen as 2 A. Photoflash capacitor 114 had a value of 1800 μF, and was charged to a maximum voltage of $V_{max}$=350 V. The total energy stored in photoflash capacitor 114 under full charge was approximately 110 J. Transistor 246 was International Rectifier model IRLL2705, having a rated maximum drain voltage of 55 V, and a maximum on-resistance of 0.04Ω. Rectifier 248 was Motorola model MUR1100E.

TABLE 1

| |
|---|
| Coupled inductor: per FIGS. 14 through 20 |
| Battery: 16 V, max 2 A current |
| Flash capacitor: 1800 μF, max 350 V (Cornell Dubilier 7P152V360A062L) |
| MOS switching transistor: I.R. IRLL2705 |
| Rectifier: Mot. MUR1100E |
| $C_d$: 0.010 μF |
| $R_d$: 2.7 Ω |

When the voltage of battery 108 was 15 V under load, time $t_1$ was 9 μs, and the measured current was 8 A. Therefore, using V=LdI/dt, the effective primary inductance was 16.8 μH.

The inductance under operating conditions is often slightly higher than that measured by a bridge at zero current, due to the shape of the B-H curve around zero flux. This measurement of 16.8 μH is very close to the 16 μH measured previously, and indicates that core 250 was not near saturation at a current of 8 A. The current at which inductor 241 began to saturate was about 12 A. Using Equation 12, with current 8 A, the energy stored in inductor 241 at the end of $t_1$, 9 μs, was therefore 0.54 mJ.

It requires 203,000 cycles of charge circuit 1500 to charge photoflash capacitor 114 from zero to full voltage, assuming that charge circuit 1500 is 100-percent efficient.

Values for damping circuit 1584 were calculated. Turns ratio N is 11; therefore, the maximum clamp voltage of secondary winding 243, 350 V, referred to primary winding 242, was approximately 32 V. Plugging in 55 V for $V_{dp}$, 15 V for $V_{bat}$, and 32 V for $V_{max}$/N into Equation 11 gave a maximum allowable value of 8.2 V for $V_p$, to keep $V_{dp}$ below 55 V.

Using Equation 13, the design value for $C_d$ was 0.015 μF. Plugging into Equation 14, a design value for $R_d$ was 2.7Ω.

In the experiment, the measured maximum drain voltage of transistor 246 did not exceed 45 V, because the rise time of secondary winding 243 was longer than the period of $C_d$ resonating with the leakage inductance. The design procedure is conservative, justifying the use of the maximum rated drain voltage for $V_{dp}$ in Equation 11.

The leakage inductance has an energy to be dissipated, as given by Equation 9, of 0.11 μH(8 A)$^2$/2=3.52 μJ. The $E_{leak}$ value of 3.52 μJ is less than 1 percent of the 0.54 mJ stored in inductor 241.

Calculation of $E_c$, the energy stored (and lost) on $C_d$ in damping circuit 1584 during each cycle, is given by Equation 15:

$$E_c = \frac{1}{2}C_d\left(\left(V_p + \frac{V_{\max}}{N}\right)^2 + (V_{bat})^2\right) = 13.7\ \mu\text{J} \quad [15]$$

The energy lost through damping capacitor 1580 also includes the energy lost through inductor leakage, so the total energy loss per cycle is 13.7 μJ, or 2.5 percent of the stored 0.54 mJ.

Charge circuit 1500 was tested with a static load. Its measured input current was 1.87 A at a battery voltage of 15 V, giving a power consumption of 28 W. Under these conditions, circuit 1500 generated a continuous voltage of 277 V across a 3070Ω load resistor, thus supplying an output power of 25 W. The efficiency of overall energy conversion was therefore 89 percent. The measured efficiency of energy conversion with capacitive load was between 87 percent and 89 percent.

The particular example embodiments described above are for illustrative purposes only, and are not intended to be limiting on the scope of the present invention. Several variants of the present invention are possible and desirable under certain circumstances.

Figure 15B:
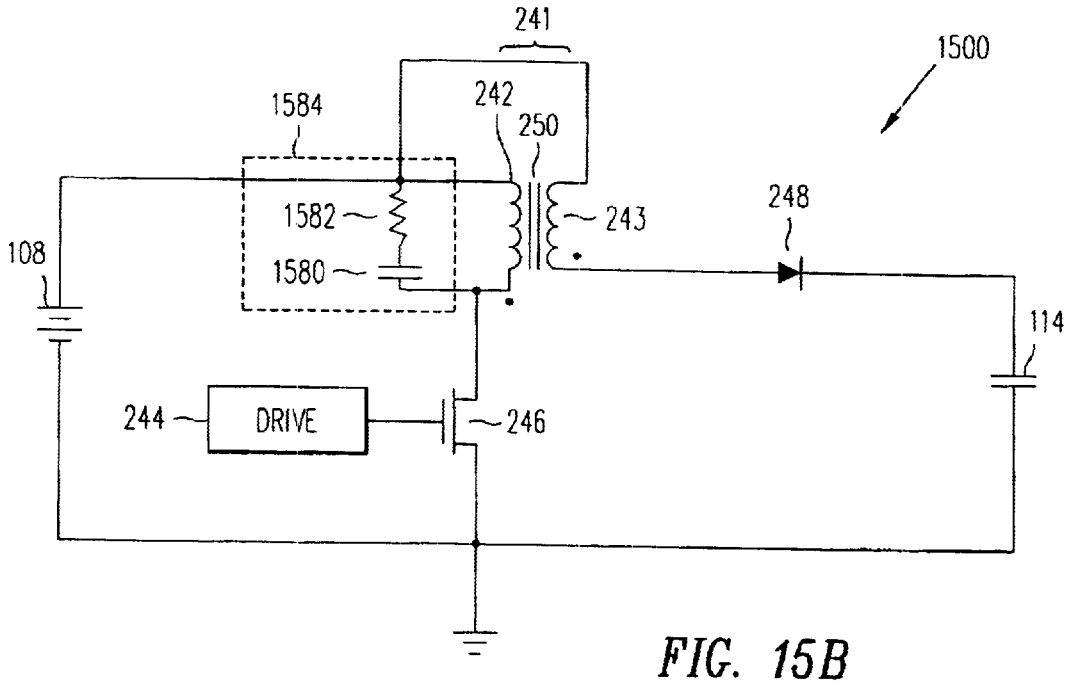
FIG. 15B is a schematic diagram of an embodiment of a flyback converter charge circuit according to the present invention, including a quick-start circuit.

FIG. 15B is a schematic diagram that illustrates embodiments of the present invention where it is desirable to connect the reference terminal of secondary winding 243 to the battery voltage, rather than to ground. This connection gives the voltage on photoflash capacitor 114 a quick start when circuit 1500 is first turned on, shortening the time required to charge capacitor 114 to its minimum flash voltage.

Figure 15C:
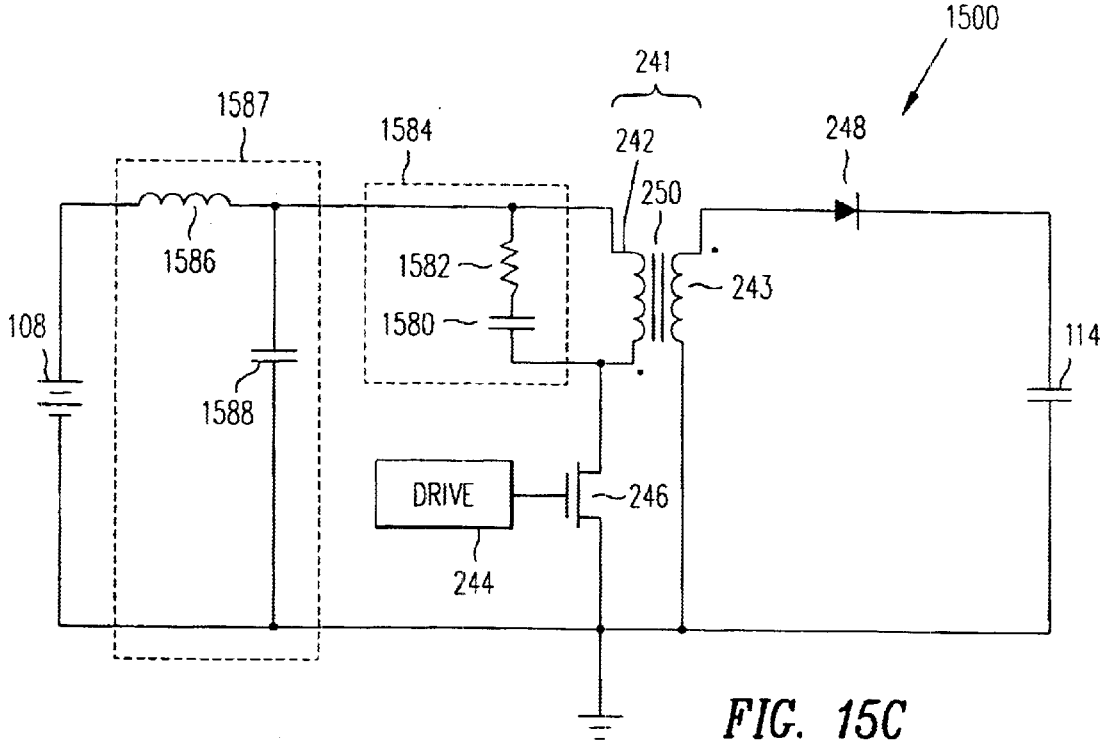
FIG. 15C is a schematic diagram of an embodiment of a flyback converter charge circuit according to the present invention, including a power smoothing filter.
Figure 15D:
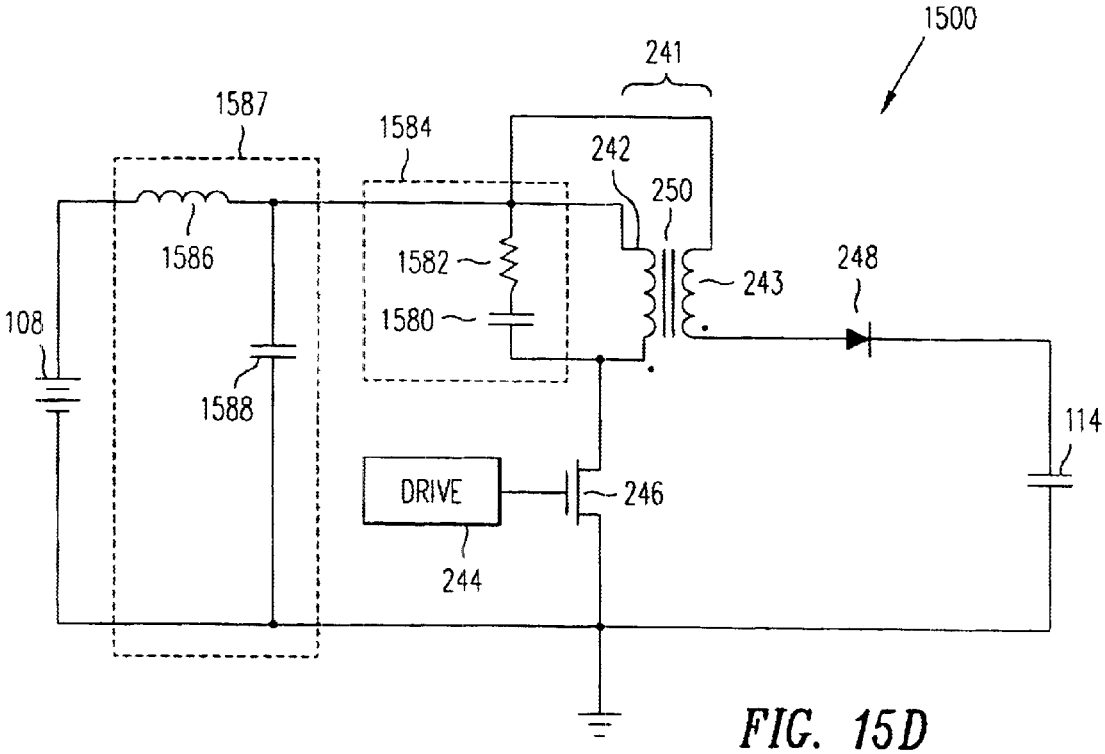
FIG. 15D is a schematic diagram of an embodiment of a flyback converter charge circuit according to the present invention, including both a quick-start circuit and a power smoothing filter.

FIGS. 15C and 15D are schematic diagrams showing the addition of filter circuit 1587 to save battery life. Battery 108 may have longer life if the current drawn from it is steady rather than pulsed. The circuits of FIGS. 15A and 15B subject battery 108 to the full peak current drain of inductor 241 at the end of time period $t_1$. However, the current may be smoothed greatly by the introduction of L-C filter 1587, comprising filter inductor 1586 and filter capacitor 1588, as shown in FIGS. 15C and 15D. In some embodiments, filter inductor 1586 is chosen to have a high impedance at the operating frequency of circuit 1500, while smoothing capacitor 1588 is chosen to supply the energy for one charging cycle without significant voltage drop.

FIG. 15D is a schematic diagram of an embodiment that combines resonant filter 1587 with the quick-start connection of secondary winding 243 to $V_{bat}$, shown in FIG. 15B.

L-C filter circuit 1587 operates as follows. As an example, a 200 $\mu$F filter capacitor charged to 15 V stores 22 mJ. The 0.54 mJ required to charge coupled inductor 241 to the latter's peak energy storage depletes the voltage on capacitor 1588 by less than 0.37 V. That voltage depletion does not represent an energy loss, because L-C filter 1587 is lossless except for the resistance of the components. A result of adding filter 1587 to charging circuit 1500 is a slight modification of the waveforms previously shown in FIG. 3. The voltage at primary winding 242 of coupled inductor 241 starts a given cycle slightly higher than the battery voltage, and ends the cycle slightly lower than the battery voltage. The resonant period of resonant circuit 1587, formed by filter inductor 1586 and filter capacitor 1588, is.typically made longer than the on-time $t_1$ of the converter, and, in some embodiments, also is made longer than the total period $t_1+t_2$ of the converter 1500.

While the quick-start arrangement shown in FIGS. 15B and 15D does get an extra 15 V start on capacitor 114, on power up, the current through secondary 243 sets up a large current in primary winding 242 which can blow out the reverse source-drain diode in FET 246. In some cases this current is about 30 A.

Figure 15E:
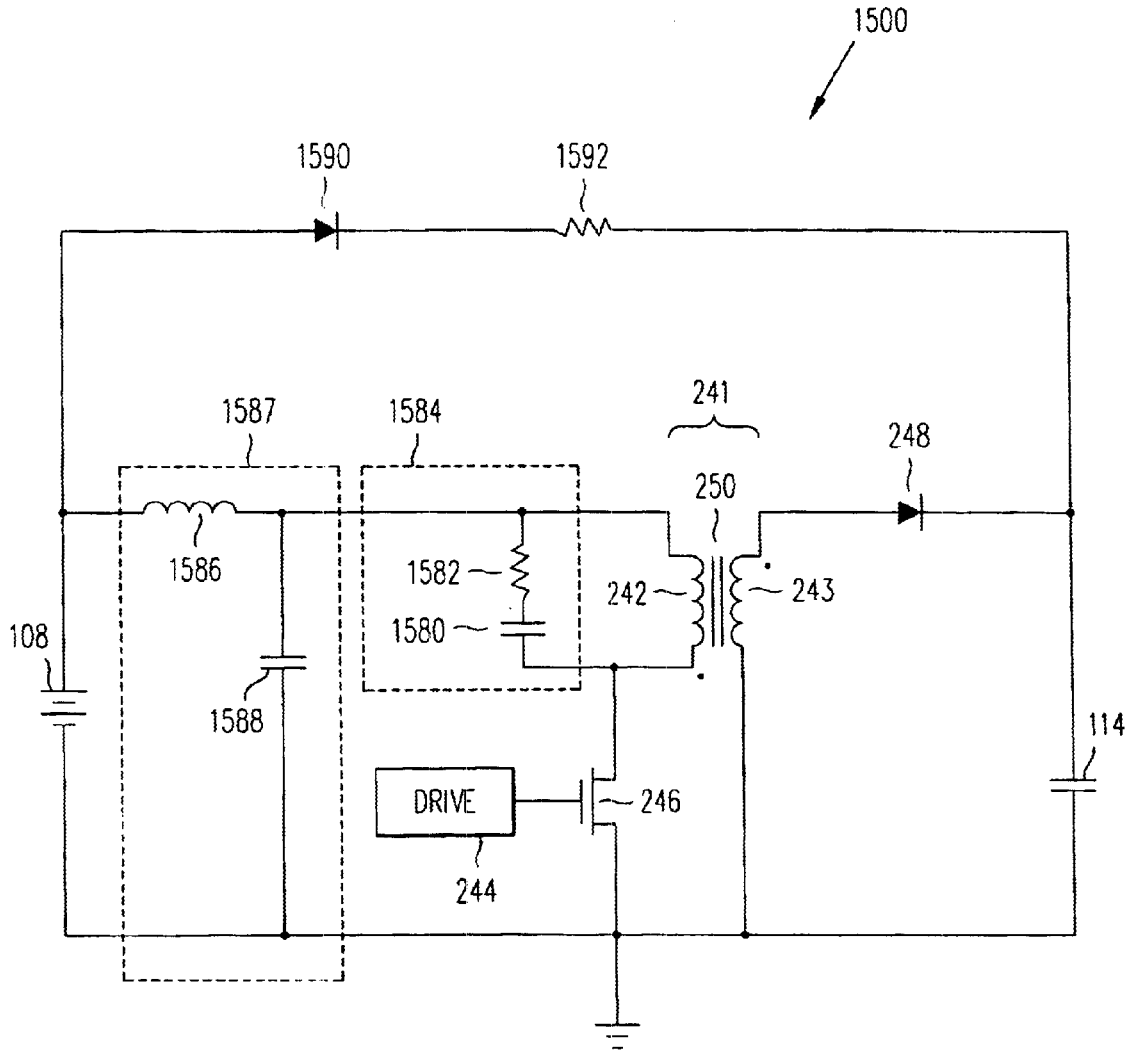
FIG. 15E is a schematic diagram of an embodiment of a quick start arrangement according to the present invention.

FIG. 15E is a schematic diagram of circuit 1500 with an improved quick start arrangement. Diode 1590 is connected from the positive side of battery 108 to flash capacitor 114 with resistor 1592 in series. This configuration charges capacitor 114 to 15 V without a large current being induced in the primary winding 242.

This configuration also has another advantage. The charge-up pulse time for capacitor 114 is inversely proportional to the voltage across secondary winding 243, $V_{secondary}$. In the circuits shown in FIGS. 15A–D, $V_{secondary}$ is near zero on the first few cycles of charge-up. Therefore, $t_{pulse}$ is very long at start up. In contrast, in the circuit of FIG. 15E, $V_{secondary}$ starts at 15 V, so the maximum $t_{pulse}$ is proportional to 1/15 V. When capacitor 114 is charged to near its maximum, 350 V, $t_{pulse}$ is proportional to 1/350 V. Therefore the longest $t_{pulse}$ (at startup) is only 23 times the shortest $t_{pulse}$ (at near full charge). The added cost of diode 1590 and resistor 1592 is minimal.

h. Inductive FET Turn-Off Control

Figure 16:
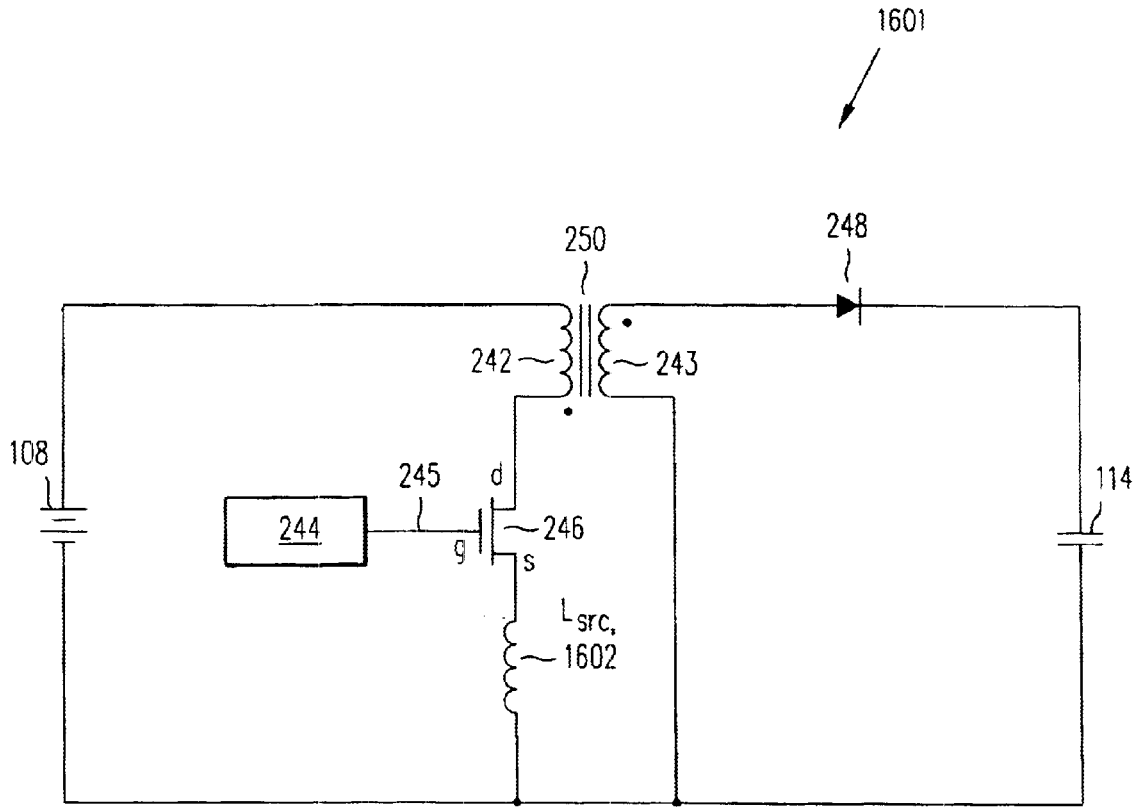
FIG. 16 is a schematic diagram of an embodiment of a flyback converter charge circuit according to the present invention.

FIG. 16 is a schematic diagram of an inductive overshoot voltage-damping circuit according to the present invention. In some embodiments, circuit 1601, employing inductor 1602, rather than circuits employing R-C circuit 1584, is used to decrease overshoot voltage. Circuit 1601 controls turn-off current, and thereby controls overshoot voltage. Primary winding 242 has parasitic inductance $L_{drain}$. Inductor 1602 has inductance $L_{src}$, and transistor 246 is a FET with a low source impedance. Inductance $L_{src}$ in series with the source of FET 246 affects the turn-off current.

Gate 245 of FET 246 is driven directly with a low impedance source, instead of with resistance in series with gate 245 as has been done with some prior-art circuits. As the voltage at gate 245 goes to zero, inductor 1602 causes source voltage $V_{src}$ to go negative very quickly, keeping FET 246 on initially with $V_{gs}$ just enough to support the level of current already flowing. The voltage across the source inductance, which equals $V_{gs}$, will remain nearly constant throughout the main part of the turnoff process. This is because the current is a very steep function of $V_{gs}$. $V_{gs}$ is given by Equation 16:

$$V_{gs} = L_{src}\frac{dI}{dt} \quad [16]$$

Since the drain and source currents are the same, the overshoot voltage is given by Equation 17:

$$V_{overshoot} = L_{drain}\frac{dI}{dt} \quad [17]$$

$V_{overshoot}$ may be controlled directly by the ratio of the drain inductance to the source inductance, according to Equation 18:

$$V_{overshoot} = V_{gs}\frac{L_{drain}}{L_{src}} \quad [18]$$

The value of dV/dt depends on only the stray capacitance in the circuit, and can be high, making for low power dissipation in transistor 246 during turn-off.

When circuit 1601 is used, turn-on and turn-off times are very fast and about equal, because $dI/dt=V_{gs}/L_{src}$. Overshoot voltage is controlled directly, allowing quick turn-off with low energy dissipation. This technique may be easier to apply as voltages and currents increase, since the ratio of drain voltage to gate voltage tends to grow larger with higher-power devices. In some embodiments, the inductance of a short trace of printed-circuit-board (PCB) wiring may be used for inductor 1602. In some embodiments, the chosen value for inductor 1602 may depend on inductance in FET 246, as well as on many other sources of inductance, such as PCB traces, wires, and other components.

Peak drain voltage $V_{dp}$ is given by Equation 19:

$$V_{dp} = \frac{V_{\max}}{N} + V_{overshoot} + V_{bat} + V_{gs} \quad [19]$$

where $V_{gs}$ is the gate-to-source voltage, $V_{bat}$ is the battery voltage, $V_{max}/N$ is the voltage across the inductor, and $V_{overshoot}$ is the voltage due to leakage inductance. Reordering terms yields Equation 20:

$$V_{overshoot} = V_{dp} - \frac{V_{\max}}{N} - V_{bat} - V_{gs} \quad [20]$$

The maximum allowable voltage due to leakage inductance, $V_{overshoot}$, is calculated by plugging into Equation 20 the maximum allowable value for $V_{dp}$, and values for $V_{max}/N$, $V_{bat}$, and $V_{gs}$ from the above discussion of charge circuit 1500 and solving, as illustrated by Equation 21:

$$V_{overshoot}=55\ V-32\ V-15\ V-3.2\ V=5\ V \quad [21]$$

Given that the same current flows through the drain and source, dI/dt is the same for source and drain currents. $V_{gs}$ will remain approximately constant for most of the way to full turn-off. $V_{gs}$ is given by Equation 22 and $V_{overshoot}$ is given by Equation 23:

$$V_{gs} = L_s \frac{dI}{dt} \quad [22]$$

$$V_{overshoot} = L_{leak} \frac{dI}{dt} \quad [23]$$

Combining Equations 22 and 23 gives Equation 24, the expression for $L_s$ in terms of the leakage inductance and the ratio of turn-on voltage to allowable inductive overshoot voltage:

$$L_s = L_{leak} \frac{V_{gs}}{V_{overshoot}} \quad [24]$$

Plugging in 5 V for $V_{overshoot}$ from the above example and using the value of 3.2 V for $V_{gs}$ (as specified for the IRLL7205), $L_s$ is 64% of the leakage inductance of 0.11 $\mu$H, or about 0.07 $\mu$H.

The energy loss occurs during turn-off, when the voltage across FET 246 is $V_{dp}$, and the current starts at $I_p$ and falls to zero. The energy loss is calculated by Equation 25:

$$E_{lost} = \int_{I=I_p}^{0} V_{dp} I \, dt \quad [25]$$

Substituting $V_{p1}/L_{leak}$ for dI/dt, and solving Equation 25, shows $E_{lost}$=38.7 $\mu$J, or 7.2 percent of the 0.54 mJ stored in the inductor, according to Equation 26:

$$E_{lost} = V_{dp} \times \frac{L_{leak}}{V_{overshoot}} \times \frac{I_p^2}{2} = 55\ \text{V} \times \frac{11\ \mu\text{H}}{5\ \text{V}} \times \frac{(8A)^2}{2} = 38.7\ \mu\text{J} \quad [26]$$

Inductive damping circuit 1601 is less energy efficient than is the R-C circuit of FIGS. 15 A–E. However, as the allowable peak voltage increases, the relative efficiency of circuit 1601 increases. For example, if a 70 V transistor is used instead of a 55 V transistor, the inductive overshoot voltage can be 20 V instead of the 5 V in the example above, so the required inductor, the total turn-off time, and the energy lost is smaller by a factor of 4.

i. Calculations for RC and Inductive Damping with Slower Rising Secondary.

Peak voltage was calculated for the above example by making the conservative approximation that the secondary reflection peaked at the same time as did the voltage due to the leakage inductance. However, voltage due to secondary reflection lags. Using the same components and a $C_d$ of 0.01 $\mu$F, peak voltage was measured at 45 V. Defining f as the fraction of the maximum that secondary reflection reaches at the inductive peak, the values of $E_{leak}$ and f are given by Equations 27 and 27.1:

$$E_{leak} = \frac{C_d}{2}\left((45 - V_{bat})^2 - \left(\frac{fV_{\max}}{N}\right)^2\right) = 3.52\ \mu\text{J} \quad [27]$$

$$f = \left((45 - V_{bat})^2 - 2\frac{E_{leak}}{C_d}\right)^{\frac{1}{2}} \frac{N}{V_{\max}} = 0.44 \quad [27.1]$$

Modification of equation 11 leads to equation 28 for the RC damping technique:

$$V_p = V_{dp} - \left(f\frac{V_{\max}}{N}\right) - V_{bat} = 16\ \text{V} \quad [28]$$

Modification of equation 20 leads to equation 28.1 for the inductive damping technique:

$$V_p = V_{dp} - \left(f\frac{V_{\max}}{N}\right) - V_{bat} - V_{gs} \quad [28.1]$$

Repeating the efficiency calculation with these values of $V_p$, which represent a bigger allowable voltage peak, shows an energy loss in R-C circuit 1584 of 1% and an energy loss in inductive circuit 1601 of 2%. Although it has lower energy efficiency, an inductive damping circuit may be preferred because it can be constructed from only a circuit trace. An inductive damping circuit may be more advantageous than an R-C circuit when there is a large margin on allowable peak voltage.

j. Driving Circuit

Some embodiments of the present invention make use of commercial separate excitation driving circuits, other drivers, or the following illustrative circuits.

Figure 17:
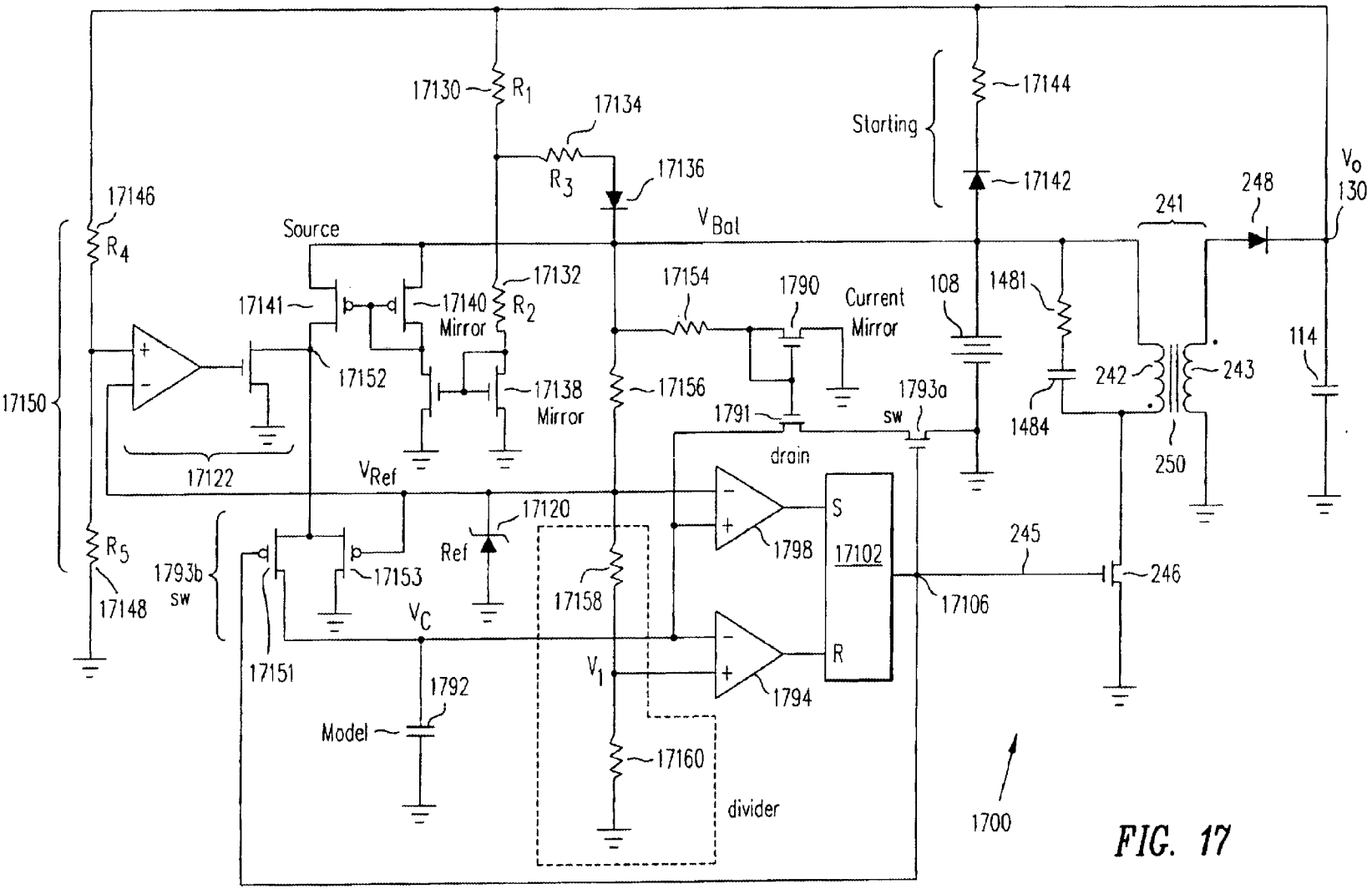
FIG. 17 is a schematic diagram of a charge circuit according to the present invention.

FIG. 17 is a schematic diagram of an embodiment of photoflash charging and driving circuits, according to the present invention. The driving portion of circuit 1700 uses transistor circuits that operate on low voltages, and are thus inexpensive and compatible with battery-powered operation. Circuit 1700 derives all necessary voltages from battery 108, and uses only a single reference voltage semiconductor. While charge voltage is low, circuit 1700 drives at an efficient rate, proportional to battery voltage and capacitor voltage; at higher charge voltages, it rolls off the charging rate, to avoid drawing too much current from battery 108.

Starting diode 17142 in series with starting resistor 17144 starts capacitor 114 at voltage $V_{bat}$, as the circuit is starting up, shortening the initial charge time at turn-on.

Figure 18:
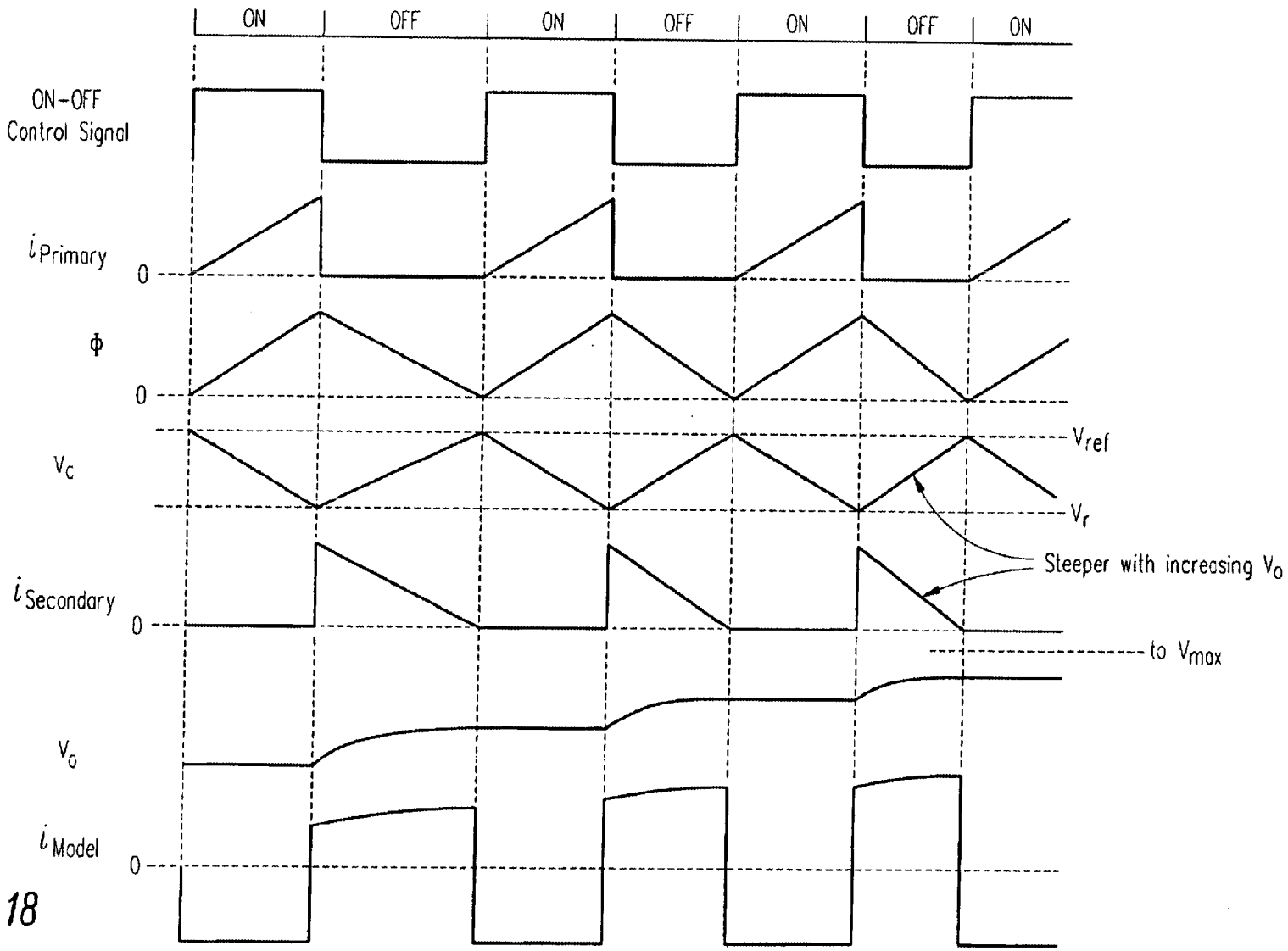
FIG. 18 is a timing diagram of the charge circuit of FIG. 17.

Circuit 1700 switches on and off the current in primary winding 242 by action of switching transistor 246 controlled by flip-flop 17102, whose output is shown by trace 1801 of FIG. 18. Flip-flop 17102 serves as a bistable controller providing an off state and an on state to control and to model the ramping up and ramping down of magnetic flux in the couple inductor.

Reference voltage $V_{ref}$ is regulated by bandgap reference element 17120. Resistors 17158 and 17160 form a voltage divider that creates second reference voltage $V_1$. If the voltage $V_c$ on model capacitor 1792, shown by trace 1804, is above $V_{ref}$, flip-flop 17102 is set by comparator 1798, and voltage $V_c$ on model capacitor 1792 is driven toward ground through a current source proportional to battery voltage, comprising transistor 1791 and transistor 1793*a*. When $V_c$ reaches $V_1$, flip-flop 17102 is reset by comparator 1794, and the voltage $V_c$ on model capacitor 1792 is driven toward $V_{bat}$ by a current source comprising transistors 17141 and transistor 17151. The rate at which $V_c$ ramps up and down, and therefore the rate at which circuit 1700 switches, is regulated as follows.

When output 17106 of flip-flop 17102 is high, model capacitor 1792 is driven toward ground by the current source transistor 1791, and MOS power-switching transistor 246 is also turned on. The magnitude of the current driving model capacitor 1792 toward ground is set by resistor 17154, which acts through a current mirror comprising transistors 1790 and 1791. Because resistor 17154 draws its current from battery 108, the magnitude of the current through transistor 1791 is approximately proportional to $V_{bat}$. Therefore, the time for the voltage $V_c$ (trace 1804) on model capacitor 1792 to ramp down from $V_{ref}$ to $V_1$ varies inversely with $V_{bat}$, as desired to produce a fixed peak amount of magnetic flux (trace 1803) in coupled inductor 241.

Transistor 1793*a* and differential switch 1793*b* (formed from transistors 17151 and 17153) control whether the model capacitor 1792 is charging or discharging, based on the state of the flip-flop 17102.

The current source through transistor 17141 of current mirror 17140, which charges model capacitor 1792, is controlled by $V_o$ and $V_{bat}$ by action of current mirror 17138 and resistors 17130 ($R_1$), 27132 ($R_2$), and 17134 ($R_3$).

When output 17106 of flip-flop 17102 is low, switching transistor 246 is off; the current through primary winding 242, shown by trace 1802, is disabled; and the current in secondary winding 243, as shown by trace 1805, flows through diode 248 to flash capacitor 114. In this condition, the voltage across secondary winding 243 is equal to the output voltage $V_o$, shown by trace 1806. The output voltage $V_o$ is therefore proportional to the rate at which the magnetic flux in the inductor will decrease during the off state.

When the output voltage $V_o$ is less than $V_b$, the off period is inversely proportional to $V_o$ for fast charging; this variable off time period is thereby regulated to be just sufficient for the magnetic flux (trace 1803) in the inductor to return to zero. However, to regulate the amount of current drawn from battery 108, circuit 1700 rolls off the charging-cycle frequency rate by increasing its off time as $V_o$ gets above voltage level $V_b$, defined by Equation 29, where $R_1$ and $R_2$ are the values of resistors 17130 and 17132, respectively.

$$V_b = V_{bat}\frac{R_1 + R_2}{R_2} \qquad [29]$$

To roll off the charging frequency, and therefore the current drawn from battery 108, diode 17136 becomes forward biased, and the current into node 17152 rises more slowly than it does for $V_o$ below $V_b$, at a rate controlled by resistor 17134. This current is mirrored first by n-type current mirror 17138, and next by p-type current mirror 17140, and thus appears as a positive current into node 17152. This current is enabled to flow onto model capacitor 1592 when output 17106 of flip-flop 17102 is low, by the action of differential switch 1793*b*, formed by p-type transistors 17151 and 17153. When output 17106 of flip-flop 17102 is high, differential switch 1793*b* directs the current out of node 17152 to ground. Net current into model capacitor 1592, $i_{model}$, is shown by trace 1807.

Figure 19:
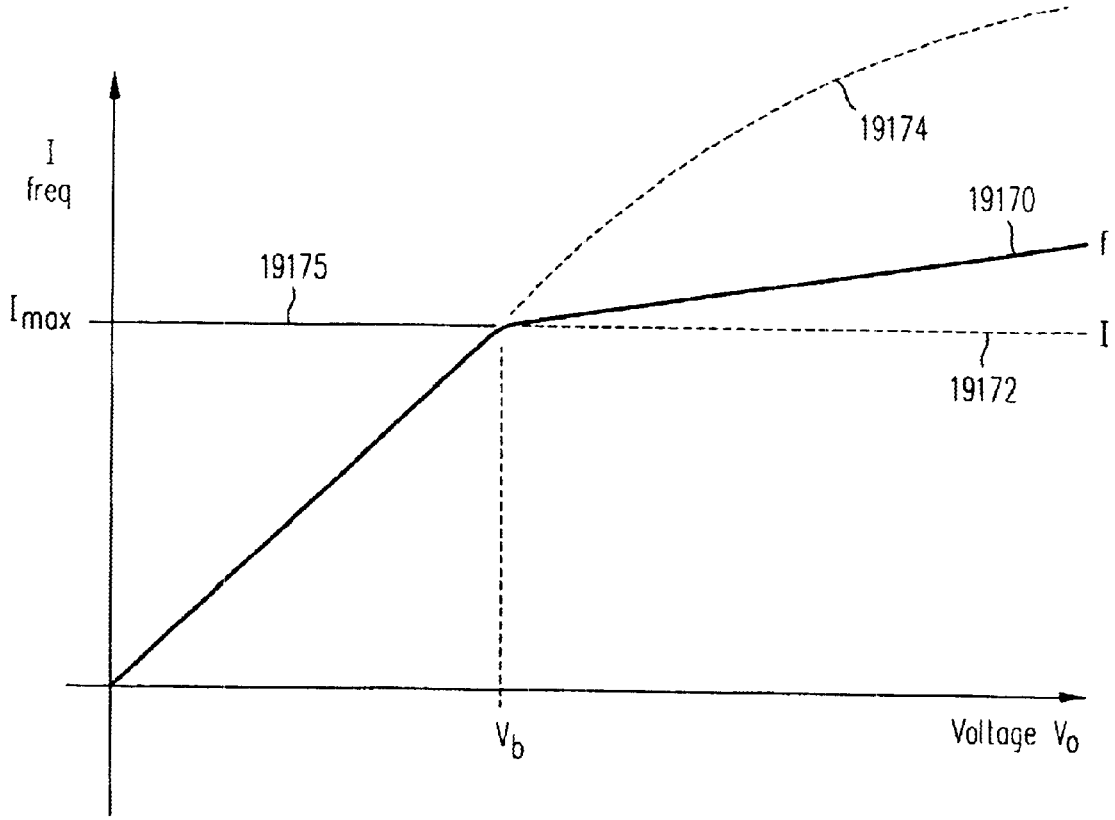
FIG. 19 is a graph of battery current and switching frequency versus capacitor charge voltage.

FIG. 19 is a graph of battery current 19172 and operating frequency 19170 versus capacitor charge for circuit 1700, and of battery current 19174 for a circuit without frequency limiting. With the frequency limiting as described above for circuit 1700, both frequency and current rise slowly or become nearly constant with increasing $V_o$ when $V_o$ is greater than $V_b$, so that battery 108 is not damaged by too much current being drawn from it.

A typical frequency of operation for drive circuit 500 (from U.S. Pat. No. 5,430,405) without battery-current control is shown by trace 19174. Current drawn from battery 108 by an example charge circuit with no current control is given by Equation 30. For a given battery voltage, the average battery current $I_{av}$ continues to rise as $V_o$ rises, and soon exceeds the maximum safe battery current (level 19175), as shown in trace 19174.

$$I_{av} = \frac{I_p}{2}\frac{t_{on}}{t_{on} + t_{off}} \approx \frac{I_p}{2}\frac{V_o}{V_o + NV_{bat}} \qquad [30]$$

For maximum battery life, in some embodiments of the present invention, battery current is limited to a maximum value that decreases as the battery voltage decreases. If the value $R_3$ of resistor 17134 is set to zero, frequency of operation is constant for $V_o > V_b$. In practice, however, for a fixed frequency of operation, the battery current actually decreases with output voltage $V_o$. For that reason, $R_3$ may be chosen such that it just compensates for this second-order effect and increases the idealized operating frequency slowly for $V_o > V_b$, as shown by trace 19170. With the proper choices of $R_1$, $R_2$, and $R_3$, battery current may be held constant at its maximum rated value as output voltage $V_o$ increases, as shown by trace 19172.

If $V_o$ becomes larger than $V_{max}$, regulation of the output voltage to the desired final value $V_{max}$ is accomplished by resistive voltage divider 17150, formed of resistor 17146 and resistor 17148. $V_{max}$ is given by Equation 31, where $R_4$ and $R_5$ are the values of resistors 17146 and 17148, respectively.

$$V_{max} = V_{ref}\frac{R_4 + R_5}{R_5} \qquad [31]$$

Values for resistors 17146 and 17148 may be chosen such that, as $V_o$ approaches $V_{max}$ transconductance amplifier 17122 begins to shunt current to ground from node 17152. Transconductance amplifier 17122 is arranged such that it can only drain current from node 17152, and cannot source current. This draining of current lowers the amount of current charging model capacitor 1792; therefore, $V_c$ rises more slowly than it would for lower values of $V_o$. This slow rise lengthens the off period, decreasing the frequency of operation. In steady state at full charge, $V_o$ is equal to $V_{max}$, and charging pulses are generated at a very slow rate: just often enough to make up for charge leaking off of photoflash capacitor 114 due to resistors 17146, 17130, and to the capacitor's own natural leakage.

Circuit 1700 of FIG. 17 includes a driving circuit that takes the battery voltage and the flash capacitor voltage as inputs, and produces a control signal to the gate of transistor 246 as output. The driving circuit can be separated out and made into an integrated circuit if the resistors 17130 and 17146 ($R_1$ and $R_4$) that connect to the relatively high voltage of the flash capacitor 114 are external to the integrated circuit. Resistors $R_1$ and $R_4$ (17130 and 17146) can be considered to be voltage-dropping resistors that provide currents proportional to the charge level of the photoflash capacitor. The driver circuit can easily be modified to use a single voltage-dropping resistor, rather than the two as shown, to accomplish the same functional control of the switching rate as described above. More generally, the driver uses a charge-level input, however the charge level may be represented, on which to base the control of switching rate. Resistor 17154 connected to battery 108 may also be external to a controller integrated circuit. The values of the external resistor are useful as programming values to make the model in the driver circuit match the particular coupled inductor converter system being controlled.

The embodiment shown in FIG. 17 is only exemplary and many variants on the design are possible. For example, MOS transistors used in the example circuit could be replaced by bipolar transistors, in which case the term "gate" would denote the base of the bipolar transistor, the term "drain" would denote the collector of the bipolar transistor, and the term "source" would denote the emitter of the bipolar transistor. The unidirectional transconductance amplifier can be implemented in numerous ways other than that shown. It may be desirable to interpose a driver circuit between output 17106 of flip-flop 17120 and gate 245 of MOS power-switching transistor 246. The polarities of charging and discharging can be interchanged, as can the polarities of the individual elements, provided that the relations among them are preserved. In the case where a negative voltage—rather than a positive voltage—is chosen, the term "larger" as used herein refers to the magnitude of that voltage. In the charge circuits of FIGS. 15 (A–E), 16, and 17, the reference node for secondary circuit 243 can be separate from that of primary circuit 242. The illustrations, examples, and description are thus not intended to limit the scope of the invention, set forth by the following claims.

APPENDIX A: DETAILED BACKGROUND

Xenon flash tubes are used for photographic lighting where insufficient natural light is available. The literature describes circuits for supplying power to these devices, and for controlling the light that they emit. However, despite the commercial resources that have been devoted to these devices, commercial flash units are relatively inefficient; typically less than 30% of the energy taken from the battery is actually delivered to the flash tube.

a. Basic Flash Circuit

Figure 1:
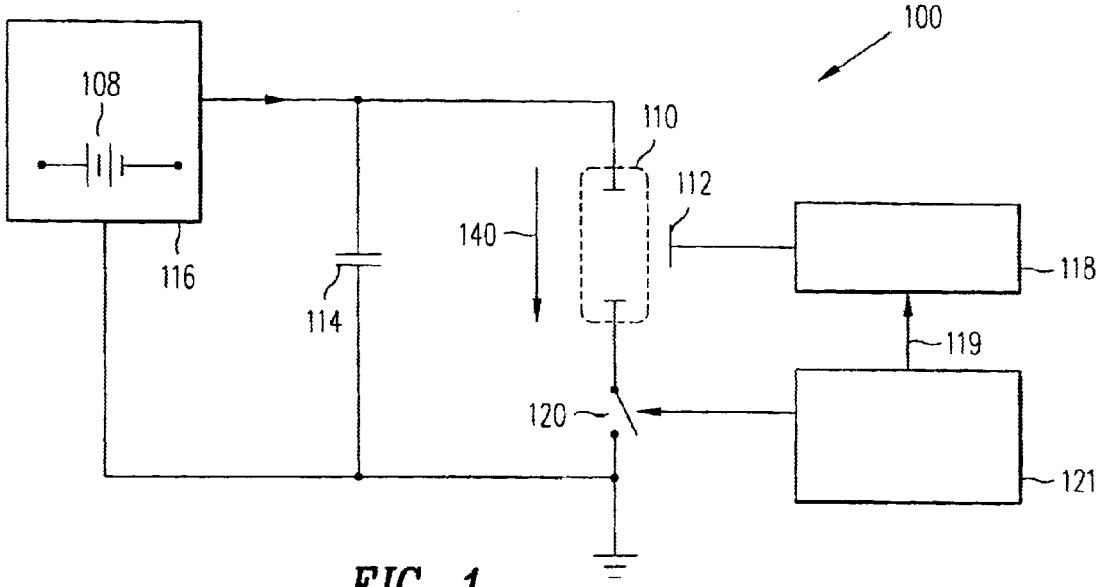
FIG. 1 PRIOR ART
FIG. 1 is a schematic diagram of a basic flash circuit.

FIG. 1 is a schematic diagram of basic flash circuit 100. Flash tube 110 is connected in parallel with storage capacitor 114, which is charged to voltage V by charge circuit 116. In its un-ionized state, the gas in flash tube 110 acts as an insulator. To generate a flash, trigger signal 119 causes ignite circuit 118 to generate a pulse of high-frequency energy, applied at excitation terminal 112. The high-frequency energy pulse couples through the envelope of flash tube 110 to the pressurized gas inside, slightly ionizing the gas and making the gas more conductive.

An electric field is present in flash tube 110 due to voltage V, at node 130, across contacts 111 and 113. On triggering, a few initial electrons in the gas are accelerated by the electric field, and gain energy sufficient that they ionize other gas atoms, liberating more electrons in an exponential cascade (avalanche discharge) in tube 110. In typical photographic flash tubes, it takes about 100 $\mu$s for the gas to become fully ionized, after which current 140 flows through tube 110. Current flow is determined by the conductance characteristics of the ionized gas.

b. Characteristics of the Discharge

Figure 20:
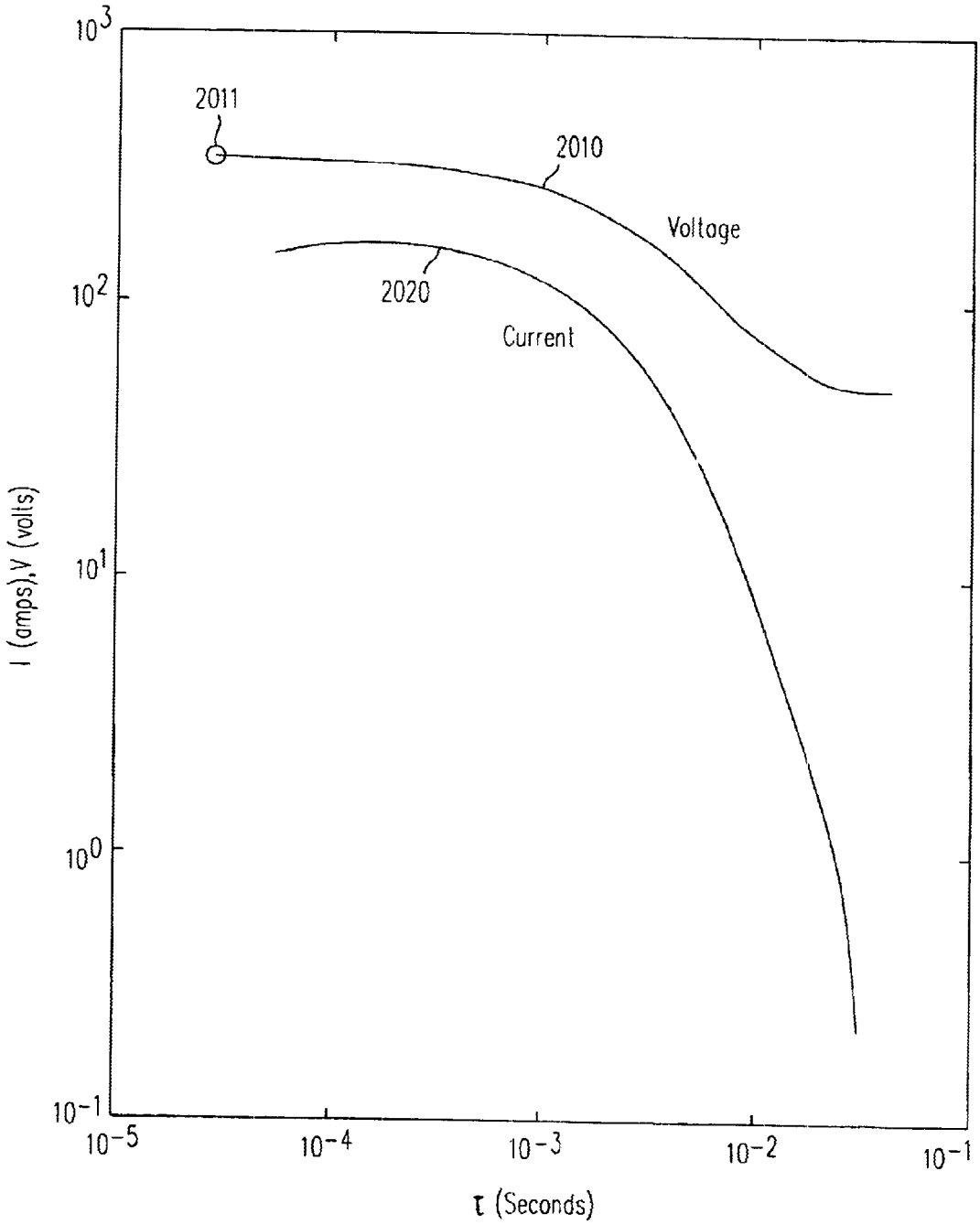
FIG. 20 is a graph of measured voltage and current of a flash discharge circuit.

FIG. 20 is a graph of measured discharge voltage, shown as curve 2010, and measured current, shown as curve 2020, of an Amglo MFT118 helical photographic flash tube. Further information on Amglo and other Xenon flash tubes is available at the Amglo Kemlite web site: http://www.amglo.com. In experimental measurements, capacitor 114 had a value of 1800 microfarad ($\mu$F), and was charged to initial measured voltage 2011, 337 V. On discharge, current 140 reached a maximum value of 165 A after 2050 $\mu$s. Current flow reduced the charge on capacitor 114 to 48 V after 25 ms, after which the discharge extinguished spontaneously.

Figure 21:
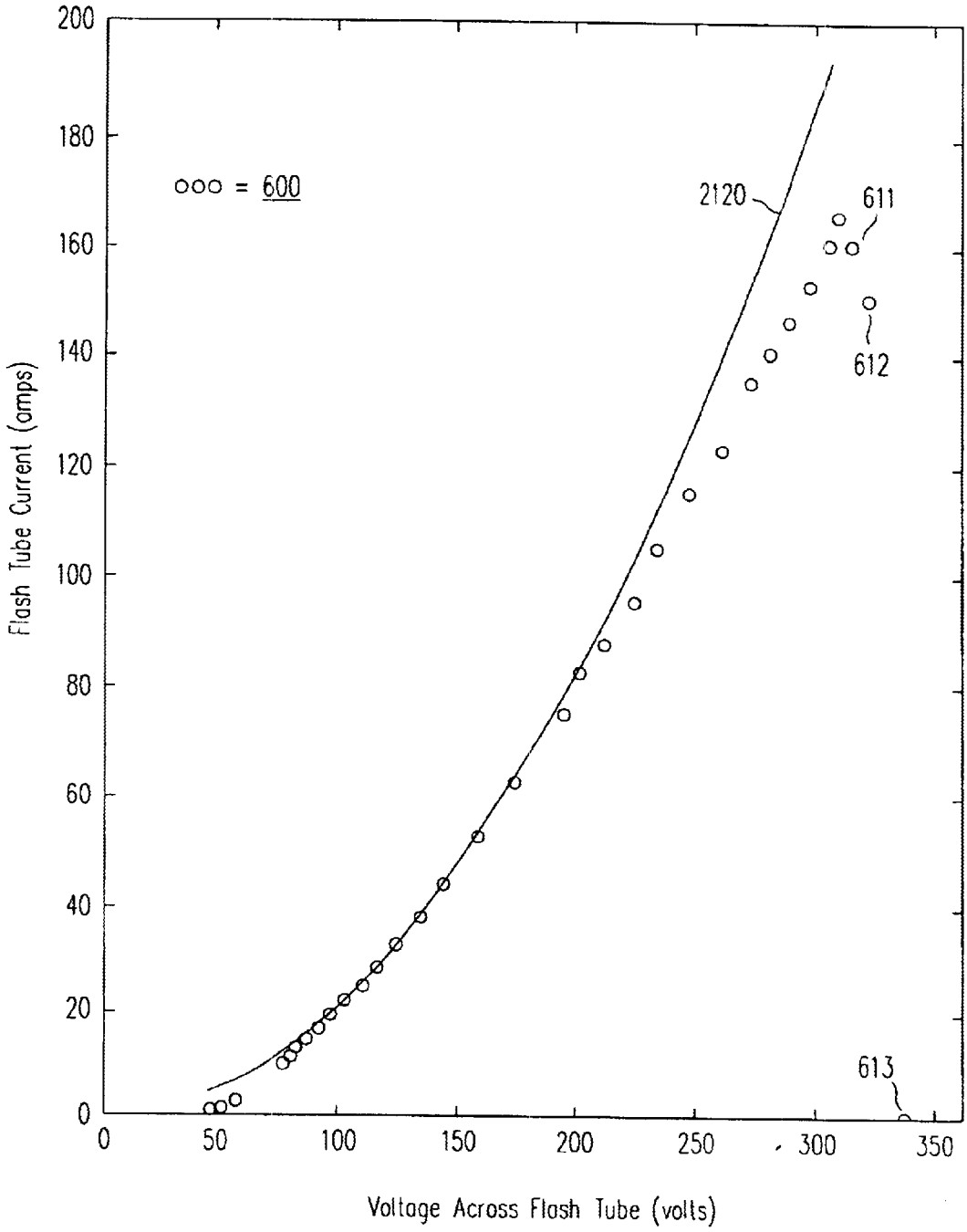
FIG. 21 is a graph comparing theoretical and measured discharge parameters.

FIG. 21 is a graph of a measured current-voltage relation from the experiment. Points 600 are derived from the data shown in FIG. 20. Three data points on the lower-right side of the graph—points 611, 612, and 613—are from the initial portion of the discharge, before the gas was fully ionized.

Equation 32 is a commonly used model of flash discharge in a fully ionized flash tube:

$$V=K\sqrt{I} \qquad [32]$$

A fit of Equation 32 to measured data (K=22) is shown by curve 2120 in FIG. 21. Curve 2120 for predicted data matches the measured current-voltage points 600 in the middle third of its range, but not in the upper and lower parts. An improved model of the current-voltage relationship has been given in Equation 1 and FIG. 6 of the present specification.

c. Termination of the Flash

Typical commercial flashes, including those used with TTL sensing, terminate the discharge while the capacitor voltage is still above $V_{min}$, which is the minimum voltage required to drive a discharge. Some flashes use inductors, coupled with an auxiliary flash tube, to rob current from tube 110 until the flash extinguishes.

Figure 22:
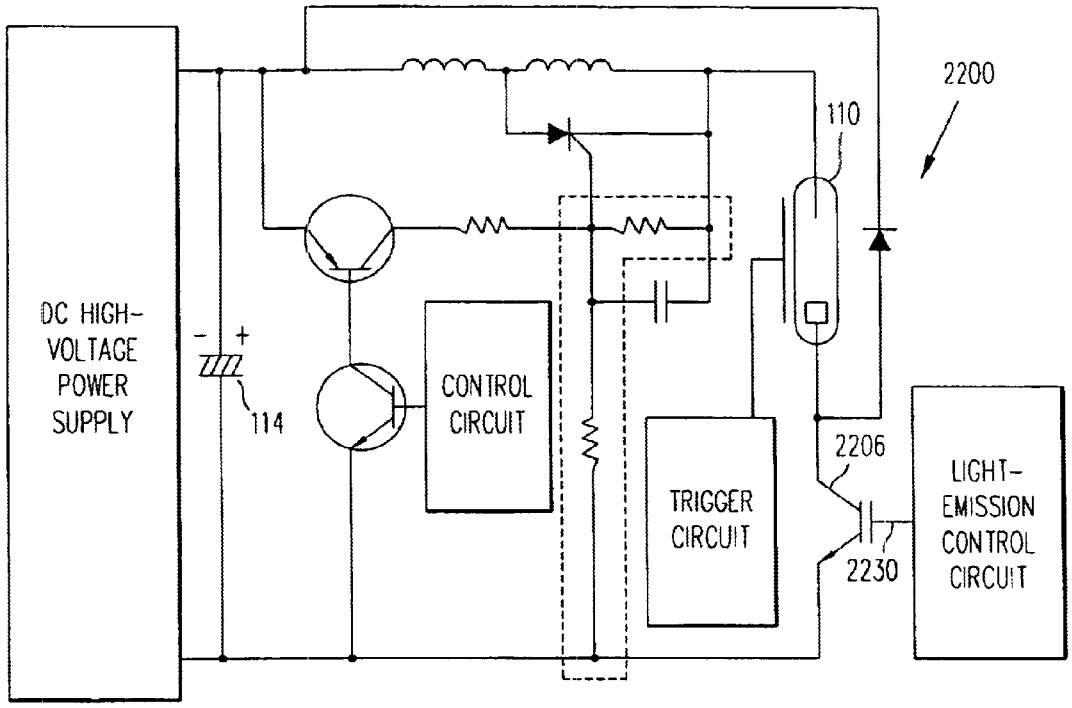
FIG. 22 PRIOR ART
FIG. 22 is FIG. 1 from U.S. Pat. No. 6,150,770, a schematic diagram of a flash apparatus capable of high-speed repeating flashes.

FIG. 22 is FIG. 1 from U.S. Pat. No. 6,150,770. In circuit 2200, minority-carrier semiconductor switching device 2206 is placed in series with main flash tube 110 to control the flash. The flash is triggered while semiconductor switching device 2206 is in a low-impedance state. To terminate the discharge, control electrode 2230 transitions semiconductor switching device 2206 into a high-impedance state, stopping the flow of current. The remaining components of FIG. 22 are discussed in U.S. Pat. No. 6,150,770.

Flash devices that use thyristors as semiconductor switching device 2206 are described in U.S. Pat. No. 5,027,039, U.S. Pat. No. 4,717,861, U.S. Pat. No. 4,155,031, U.S. Pat. No. 4,132,923, U.S. Pat. No. 4,091,308. U.S. Pat. No. 4,012,665, 4,007,398, and U.S. Pat. No. 3,947,720. Insulated-gate bipolar transistors (IGBT) have been used as semiconductor switching devices in U.S. Pat. No. 6,150,770, U.S. Pat. No. 5,869,936, U.S. Pat. No. 5,717,962, U.S. Pat. No. 5,640,620, U.S. Pat. No. 5,532,555, and U.S. Pat. No. 5,130,738.

Because flash discharge requires high current, it is desirable that semiconductor switching device 2206 have a very low on resistance. In its off state, device 2206 holds off the maximum voltage of capacitor 114 without breaking down. So that a high breakdown voltage can be achieved, at least one region of semiconductor switching device 2206 is fabricated from high-resistivity material. However, this high-resistivity material is typically incompatible with a low on resistance. In some semiconductor devices, low on resistance is achieved by injection of minority carriers into the high-resistivity region, where they are stored while the device is in its on state.

When the flash is initiated, the initial on resistance of semiconductor switching device 2206 is high. As current builds up, that current is carried by minority carriers. Densities of both minority and majority carriers in the high-resistance region increase in proportion to the current. At the peak current of the flash discharge, the density of minority carriers is a maximum. The number of minority carriers stored is much larger than the number of majority dopant atoms; this relation enhances conductivity. The resistivity of the region is much lower in the on state than would be possible if the region was required to conduct the on current with only its native majority carriers. This conductivity enhancement is called "conductivity modulation." Although the problem of achieving a low on resistance may be addressed by conductivity modulation, two new problems are created: timing uncertainty and power dissipation during the turn-off transient.

The large excess of stored minority carriers must be removed from the conductivity-modulated region for semiconductor switching device 2206 to turn off. In both thyristors and IGBTs, at least one conductivity-modulated region lacks direct contact to a device terminal, so minority-carrier removal from this region is accomplished by recombination with majority carriers. The time required for recombination to remove the excess minority carriers is called the "minority-carrier storage time." This minority-carrier storage time may be many tens of microseconds, and is longest and more uncertain when the current is highest. So as to ensure that the semiconductor switching device is off, the control terminal may be held in its off state well beyond the worst-case minority-carrier storage time.

In many of the above-referenced patents, auxiliary devices-such as inductors, capacitors, diodes, and even additional semiconductor devices-are required for proper turn-off. Circuit 2200 of FIG. 22 is an example of such a design.

Parasitic transient power dissipation is another limitation in devices using minority-carrier storage to achieve low on resistance. At the end of the minority-carrier storage time, just before semiconductor switching device 2206 turns off, the resistance of the conductivity-modulated region is high while a large current is still flowing. Power is dissipated through this high resistance. Parasitic transient power dissipation is particularly severe when the flash is terminated shortly after it is initiated, at which time the total emitted flash energy is still small.

In some cameras, several low-energy flashes are emitted to reduce red-eye and to estimate lighting conditions prior to the image being recorded. Some designs use a series of short flashes for the main exposure. However, because the required off time of the flash includes waiting during minority-carrier storage time, the rate at which short flashes can be initiated is limited.

Compensating for parasitic transient power dissipation and timing uncertainty can require elaborate complications in the flash circuit. For example, in U.S. Pat. No. 4,285,588 and in U.S. Pat. No. 4,071,808, a plurality of flash capacitors and a plurality of thyristors are used. The problem is sufficiently severe that some implementations-for example, U.S. Pat. No. 5,869,936—employ one or more auxiliary capacitors, each with attendant semiconductor devices, to recover a portion of the energy. The result is a complex and costly circuit that is only partially effective.

d. Charge Circuit

After photoflash capacitor 114 (shown FIG. 1) has discharged, charge circuit 116 replaces the charge on photoflash capacitor 114. In a typical portable camera, the primary source of energy is battery 108. Typical flash batteries have a voltage of from about 3 V for small cameras up to about 20 V for professional flash attachments. Charge circuit 116 boosts the battery voltage to a capacitor charge voltage on the order of 350 V.

After a flash, voltage on capacitor 114 is reduced to $V_{min}$, which is about 50 V. Charge circuit 116 then incrementally delivers charge to capacitor 114 from $V_{min}$ to its final voltage of about 350 V. Charge circuit 116 therefore typically operates over a 7-to-1 (350 V to 50 V) range of output voltage. Efficiency of a continuous-conduction transformer-based switching power supply is limited to the ratio of minimum to maximum output voltage. At the 7:1 ratio, efficiency would be 14%.

The reason for this efficiency limitation is that a continuous-conduction circuit acting as a voltage source delivers charge at the highest output voltage. When capacitor voltage is below maximum, charge circuit 116 dissipates an amount of energy given by the voltage difference multiplied by the charge delivered. To increase efficiency, some charge circuits use a plurality of power supplies with a plurality of output voltages; examples of such approaches are shown in U.S. Pat. No. 4,179,728, U.S. Pat. No. 4,075,536, and U.S. Pat. No. 3,821,635. Such circuits are complex and are only partially effective.

Figure 23:
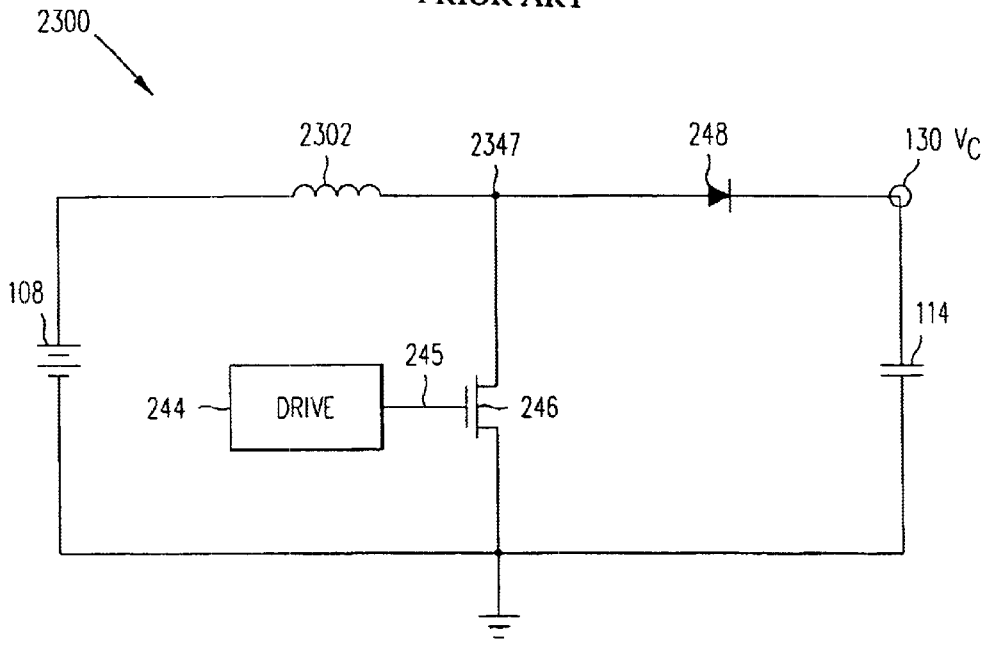
FIG. 23 is a schematic diagram of a single-inductor charge circuit.
Figure 24:
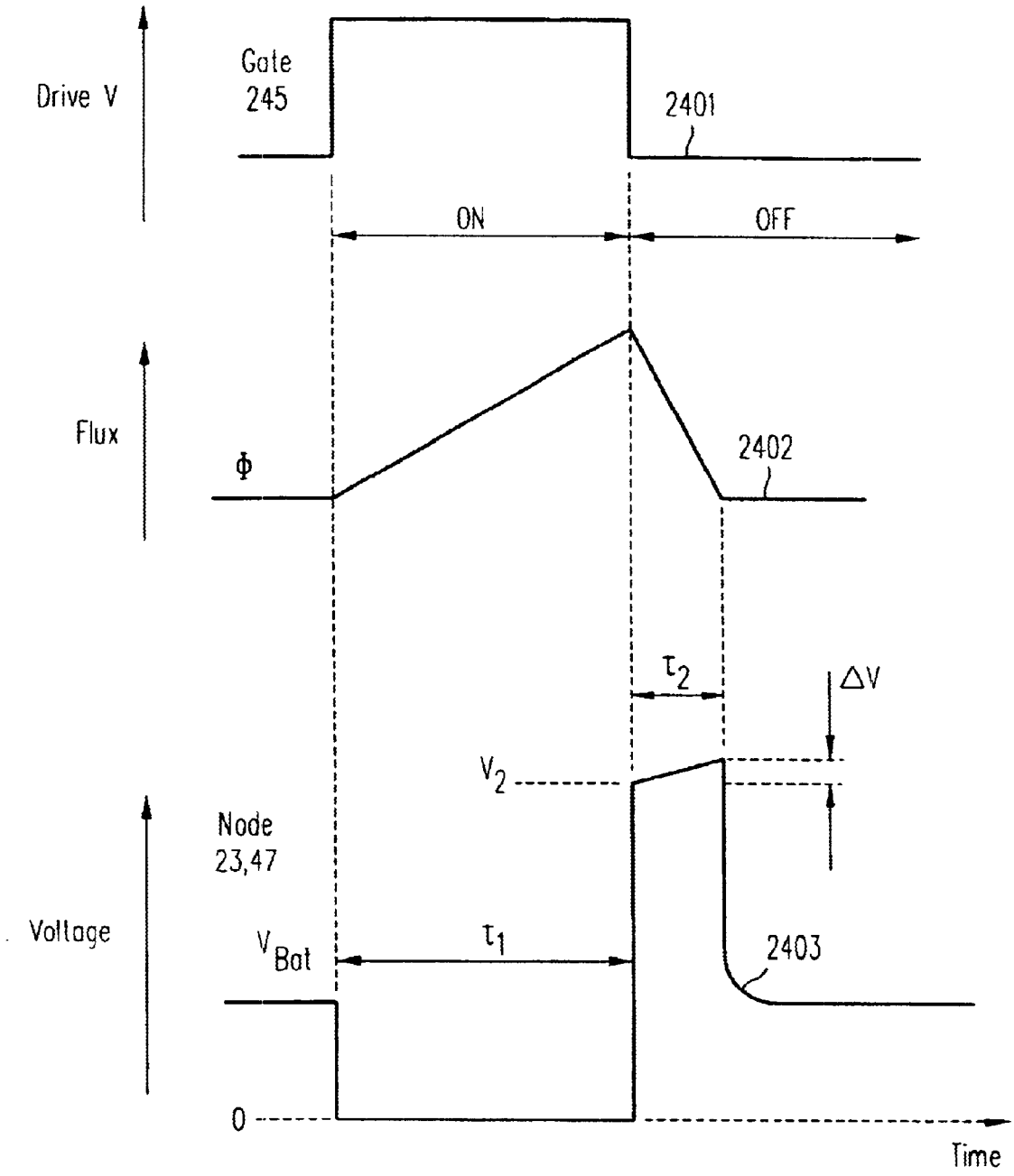
FIG. 24 is a timing diagram of the charge circuit of FIG. 23.

FIG. 23 is a schematic diagram of an example boost converter: a discontinuous-conduction switching power converter. FIG. 24 is a timing diagram illustrating the operation of boost-converter circuit 2300. Drive voltage at gate 245 is shown as trace 2401, flux in inductor 2302 is shown as trace 2402, and the voltage at node 2347 is shown as trace 2403.

Drive circuit 244 applies a drive pulse to gate 245 of MOS power switching transistor 246 for time period $t_1$, as shown in FIG. 24. The gate voltage applied during this period is higher than the on gate voltage of MOS power switching transistor 246, which therefore connects battery 108 across inductor 2302. Magnetic flux $\Phi$ in inductor 2302 increases linearly with time according to Equation 33, $$\frac{d\Phi}{dt} = L\frac{dI}{dt} = V \qquad [33]$$

where, for time period $t_1$, $V=V_{bat}$.

Energy from battery 108 generates current I in inductor 2302, thereby storing energy E according to Equation 34 and as shown in FIG. 24.

$$E=LI^2/2 \qquad [34]$$

At the end of time period $t_1$, drive circuit 244 applies an off-level voltage, below the threshold voltage of MOS power switching transistor 246, to gate 245, thereby changing transistor 246 into an open circuit. The magnetic flux in inductor 2302 may be thought of as the collective momentum of the electrons. This momentum causes the current in inductor 2302 to continue to flow, even though it cannot flow through MOS power switching transistor 246. This current charges node 2347 to a sufficient voltage, $V_2$ (as shown in FIG. 24), to forward bias diode 248, and current flows into capacitor 114, increasing charge voltage by $\Delta V_2$.

Because the continuing current in inductor 2302 is working against voltage $V_2$, which is larger than $V_{bat}$, the current (and attendant magnetic flux) will decrease according to Equation 33 with $V=-(V_2-V_{bat})$. When magnetic flux $\Phi$ reaches zero, current ceases to flow, and charging time period $t_2$ comes to an end. The two time periods are therefore related by Equation 35:

$$\Phi_{max}=V_{bat}\,t_1=(V_2-V_{bat})t_2 \qquad [35]$$

Making the approximation that increase in capacitor voltage $\Delta V_2$ during time period $t_2$ is small compared with voltage $V_2$, and that there are not other losses, $\Delta V_2$ is given by the energy transfer relationship Equation 36:

$$\frac{\Phi_{max}^2}{2L} = \frac{1}{2}LI_{max}^2 = \frac{V_{bat}^2 t_1^2}{2L} = C\Delta V_2 \qquad [36]$$

e. Limitations of Charge Circuits

In principle, circuit 2300 is capable of converting battery energy into energy stored on capacitor 114 with efficiency limited by only the parasitic resistance of the components. In practice, however, circuit 2300 has limitations.

As capacitor voltage becomes much larger than battery voltage, $t_2$ becomes much smaller than $t_1$. A typical inductor has energy capacity that is orders of magnitude lower than that of a flash capacitor. Therefore, circuit 2300 operates over several hundred thousand cycles for each recharge.

As an example, at 200,000 cycles per charge, accommodating a flash every 2 seconds requires $t_1$ to be on the order of 10 $\mu$s. If the maximum capacitor voltage is 50 times the battery voltage, $t_2$ is on the order of 200 ns. To charge a flash capacitor at this rate requires use of an extremely high-speed, high-voltage diode as diode 248.

Many high-voltage diodes achieve their performance by using conductivity modulation. But, once forward-biased, a conductivity-modulated diode transitions for approximately a minority-carrier storage time period before it becomes non-conducting again. The reverse current carried by the diode during the diode's minority-carrier storage time (before it turns off) leads to a loss of energy efficiency because current (and therefore energy) is drained back out of the capacitor. This inefficiency becomes more severe as $t_2$ became shorter.

A second practical limitation is that MOS power switching transistor 246 withstands the maximum capacitor voltage (e.g., 350 V) when it is non-conducting, and carries the battery current when it is conducting. In the example given above, the Volt-Amp rating of MOS power switching transistor 246 is 50 times the power that is actually being delivered to capacitor 114. A device required to function within both of these limitations could be expensive. Also, the gate capacitance of a MOS power switching transistor that met the specifications would be about 50 times higher than that of a more appropriately sized MOS power switching transistor, and thus the drive power supplied by drive circuit 244 also would have to be 50 times as high. Oversized circuits lower energy efficiency.

f. Flyback Converters

Figure 2:
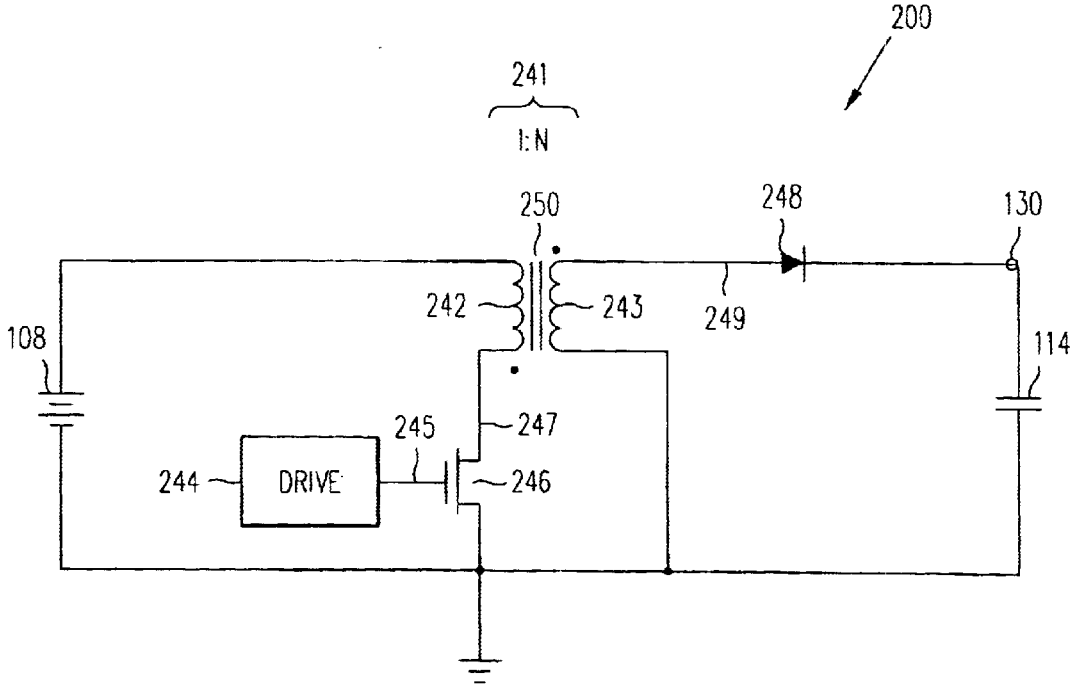
FIG. 2 PRIOR ART
FIG. 2 is a schematic diagram of a coupled-inductor (flyback converter) charge circuit.

FIG. 2 is a schematic diagram of a flyback converter charge circuit. Circuit 200 is similar to circuit 2300; however, single inductor 2302 has been replaced by coupled inductor 241, made up of primary winding 242 and secondary winding 243. A coupled inductor is distinguished from a transformer in that, in the former, current flows in only one winding at one time. Primary winding 242 and secondary winding 243 are wound on common core 250 and share magnetic flux. Secondary winding 243 has N turns for every turn of primary winding 242, giving a turns ratio of N. Because of the turns ratio, voltage 249 across secondary winding 243 is N times the voltage across primary winding 241.

Because windings 242 and 243 have different numbers of turns, output voltage and current calculations from single-inductor circuit 2300 are modified accordingly. Magnetic flux is the line integral of the vector potential around a closed path, such as a single turn of a winding. Defining $\phi$ as flux per turn, total flux for a winding is $\phi$ multiplied by the number of turns. The vector potential—the flux per turn—is shared by windings 242 and 243. If n is the number of turns in primary winding 242, then Nn is the number of turns in secondary winding 243. If the total flux in primary winding 242 is $\Phi_1$, then the corresponding flux in secondary winding 243 is $\Phi_2=N\Phi_1$.

Figure 3:
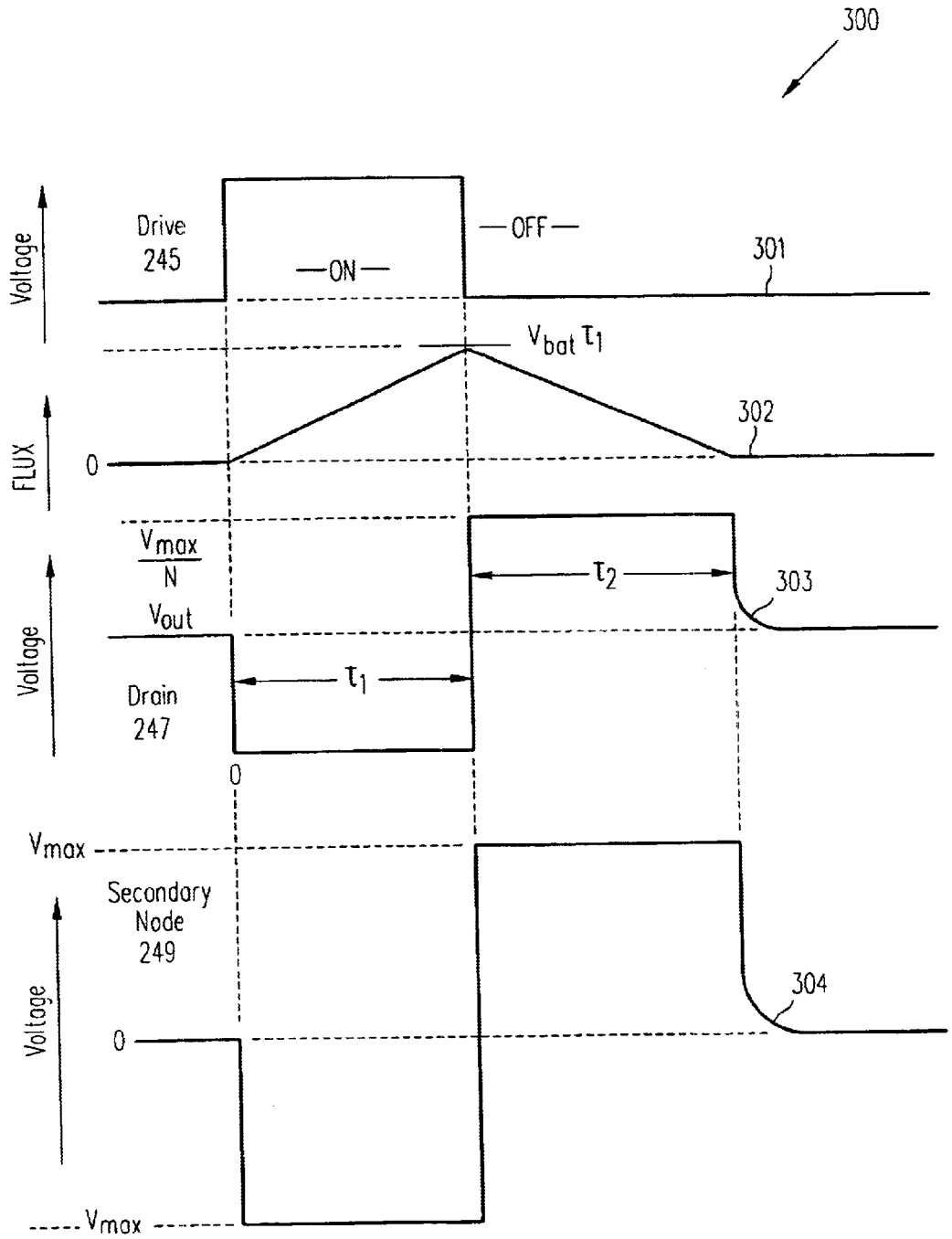
FIG. 3 PRIOR ART
FIG. 3 is a timing diagram of a coupled-inductor (flyback converter) charge circuit.

FIG. 3 is a timing diagram for circuit 200. Drive circuit 244 applies a drive pulse, shown as trace 301, to gate 245 of MOS power switching transistor 246 for a time period $t_1$. The pulse of on-level gate voltage causes MOS power switching transistor 246 to connect battery 108 across primary winding 242, pulling to ground drain voltage $V_{drain}$, which is shown as trace 303. Magnetic flux $\Phi$ in primary winding 242, shown as trace 302, increases linearly with time according to the relation $\Phi=V_{bat}t$. After time $t_1$ has elapsed, flux $\Phi$ is at its maximum value, $\Phi_{max}$, given by Equation 37:

$$\Phi_{max}=V_{bat}t_1 \quad [37]$$

At the end of time period $t_1$, drive circuit 244 turns off MOS power switching transistor 246. Current (electron momentum) established in primary winding 242 by the voltage from battery 108 cannot continue to flow. However, secondary winding 243 carries current through high-voltage diode 248 onto capacitor 114, increasing the latter's charge. Voltage across secondary node 249 is shown as trace 304 in FIG. 3. Because the continuing current is in secondary winding 243, the initial secondary flux will be $N\Phi_{max}$. Because the electron momentum is working against voltage $V_2$, magnetic flux $\Phi_2$ in secondary 243 will decrease according to the relation $\Phi_2=N\Phi_{max}-V_2t$. After time period $t_2$, flux has decreased to zero; therefore, $\Phi_{max}$ is also given by Equation 38:

$$N\Phi_{max}=V_2t_2 \quad [38]$$

If $\Phi_{max}$ is eliminated from Equations 37 and 38, the relation between time periods $t_1$ and $t_2$ is given in Equation 39:

$$NV_{bat}t_1=V_2t_2 \quad [39]$$

If turns ratio N is chosen to be of the same order as $V_2/V_{bat}$, then $t_1$ and $t_2$ will be comparable, as illustrated in FIG. 3.

The voltage at drain 247 of MOS power switching transistor 246 has a maximum near twice the battery voltage, and diode 248 has time to recover from minority-carrier storage, but must withstand a maximum reverse bias of twice the maximum capacitor voltage. These constraints are easier and more economical to satisfy than are the high-speed switching time for diode 248 and power requirements on MOS switching transistor 246 of boost-converter circuit 200. Charging circuits that use a flyback converter are described in U.S. Pat. No. 6,219,493, U.S. Pat. No. 5,430,405, and U.S. Pat. No. 4,272,806.

g. Control of Overshoot Voltage Spikes

In some charging circuits that switch large currents, fast turn-off times are desired for high efficiency and low power dissipation in the turn-off switch. However, large rates of change of current through circuit inductance cause overshoot voltages.

Figure 25:
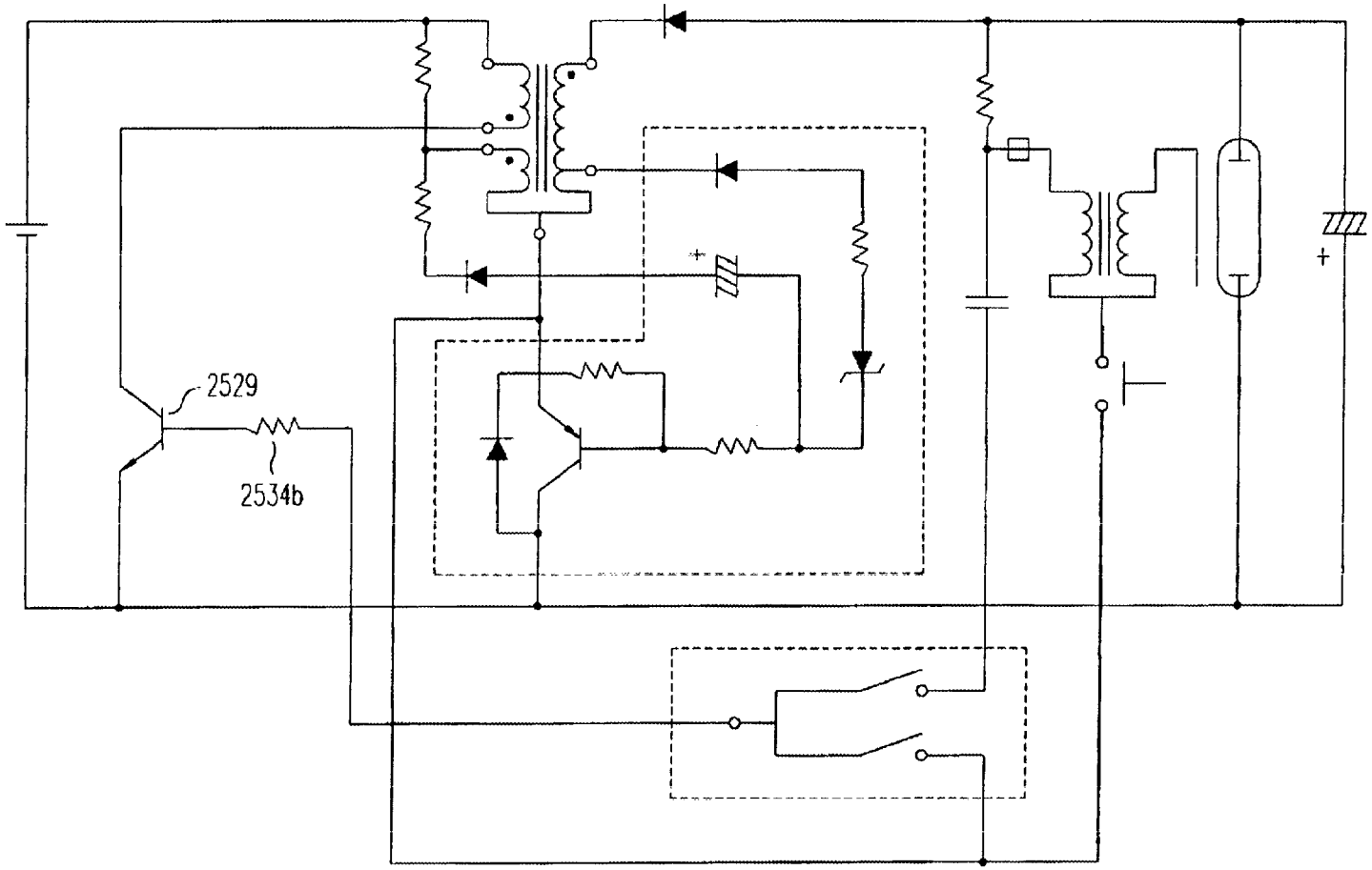
FIG. 25 PRIOR ART
FIG. 25 is FIG. 3 from U.S. Pat. No. 6,091,906, a schematic diagram of a complex prior-art flash.

FIG. 25 is FIG. 3 of U.S. Pat. No. 6,091,906; it illustrates charging circuit 2500. Bipolar transistor 2529 is used as a turn-off switch. Overshoot voltages are addressed by resistor **2534*b* being in series with the base of bipolar transistor 2529. The base voltage is approximately constant during the high-current phase of the turnoff, and resistor 2534*b***, in conjunction with the base-collector capacitance, becomes an integrator, which controls the dV/dt of the collector.

However, since the base voltage is typically above the full turn-on voltage for bipolar transistor 2529, there is a time delay between the time that a turn-off voltage is sent to resistor **2534*b*, and the time that bipolar transistor 2529 starts to turn off. There is a corresponding turn-on wait, after the pulse rises and before the voltage reaches the turn-on voltage. There is no direct control of the overshoot voltage; rather, there is control of only dV/dt. Depending on other circuit elements, this circuit may not control overshoot voltages effectively. The remainder of the components in FIG. 25** are discussed in U.S. Pat. No. 6,091,906.

h. Coupled Inductors for Charge Circuits

The maximum energy delivered to capacitor 114 during any one cycle of flyback circuit 200 (FIG. 2) is the energy stored in core 250 at saturation. Cores become lossy when they are close to saturation. Limiting the drive current to prevent core saturation conserves energy.

Flash capacitor 114 may be recharged rapidly so that the photographer does not have to wait before taking the next photograph. Charge circuits employing such cores may run at low efficiency so that the capacitor can be charged rapidly. For rapid charging to be possible, flyback converter 200 must be at a high frequency, thereby converting, as many times per second as possible, the magnetic energy stored in the core into electric energy of charge stored on capacitor 114. Some cores made from ferromagnetic material, however, have loss that increases rapidly with frequency, even when they are driven well below saturation. Core materials and configurations are discussed further in *Magnetic Field Evaluation in Transformers and Inductors*, L. H. Dixon and *Transformer and Inductor Design Handbook*, W. T. McLyman, Marcel Dekker, 1988.

i. Limitations of Coupled Inductors

Figure 4A:
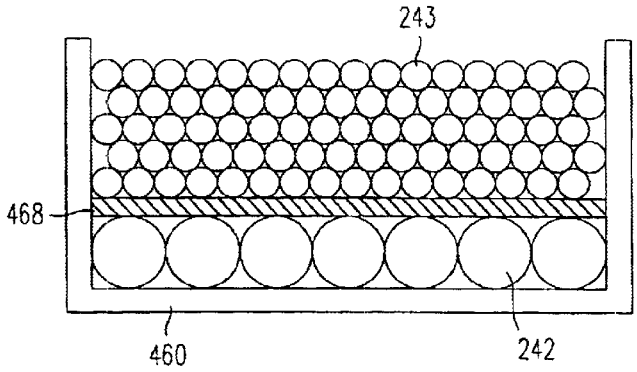
FIG. 4A (Prior Art)
FIG. 4A is a cross-sectional diagram of a winding of a coupled inductor.

FIG. 4A is a cross-sectional view of windings 242 and 243 of typical coupled inductor 241 used for experimental measurements. Windings 242 and 243 were wound on plastic bobbin 460, and insulated from each other by insulating tape 468. Primary winding 242 was formed of seven turns of #16 insulated magnet wire; secondary winding 243 was formed of 76 turns of #30 insulated magnet wire.

Figure 4B:
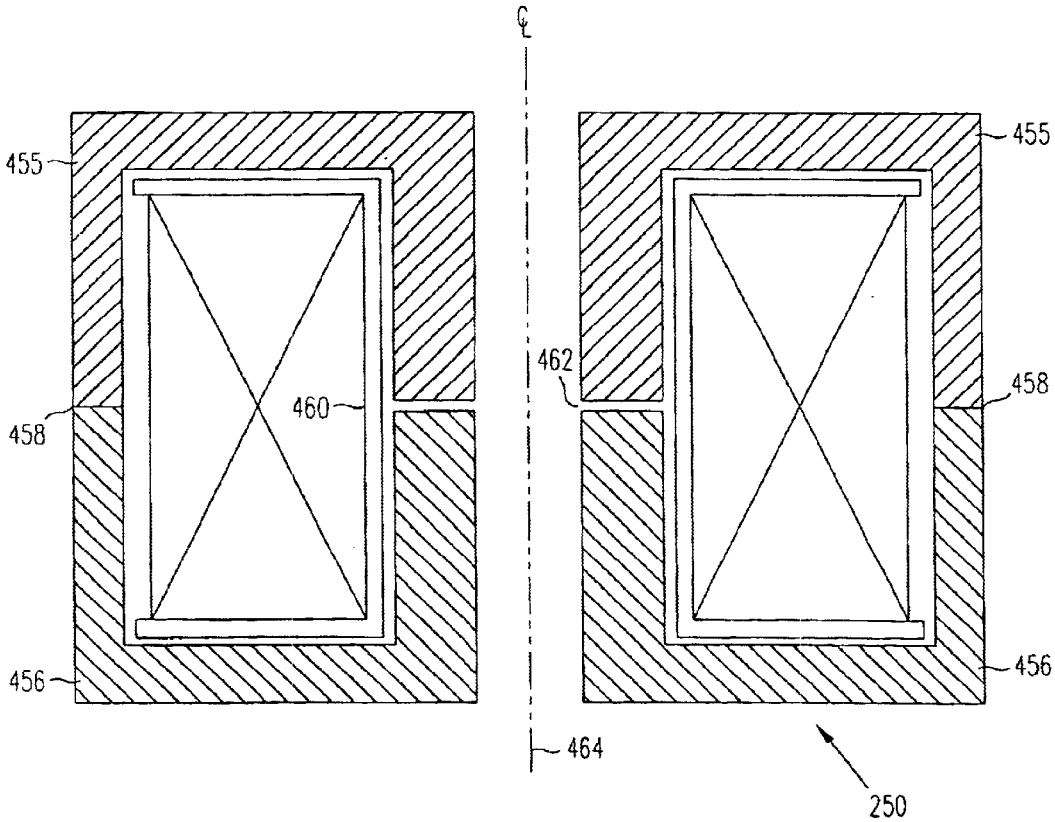
FIG. 4B PRIOR ART
FIG. 4B is a cross-sectional diagram of a core of a coupled inductor.

FIG. 4B is a cross-sectional view of a ferrite core. Core 250 was ferrite "pot" core model P-P26/16-3F3-A315 supplied by Ferroxcube (information concerning both the material and the core configuration is available on the web site: http://www.ferroxcube.com). Ferrite core 250 was made in two halves 455 and 456, which match at part line 458. The central part contained gap 462, of 0.35 mm, which introduced a thin region of air into the otherwise high-permeability magnetic path. Gaps typically linearize the flux-drive curve, making performance characteristics more repeatable. Within the inner core space, plastic bobbin 460 supported windings 242 and 243, shown with a large "X" in FIG. 4A. The construction of windings 242 and 243 has a major influence on efficiency of a flyback converter charge circuit such as circuit 200.

The example inductor was measured to have, at 100 kHz, a primary inductance with secondary open of 15.9 $\mu$H, and secondary inductance with primary open of 1.85 mH. The ratio of inductance was the square of turns ratio N, as expected. The primary resistance at 1 kHz was 26 m$\Omega$; at 100 kHz, however, it was 113 m$\Omega$. Skin effect is the increase in resistance (added parasitic resistance) with frequency. Skin effect is caused by currents confined to the surface of the conductor at high frequencies. This parasitic resistance was measured with a sine wave at 100 kHz to be 4.5 times larger than the intrinsic wire resistance. In typical primary windings (as shown in FIG. 4B), large cross-sectional area is achieved through use of wire that has a large diameter, so that resistance, and losses due to resistive loss, are lowered. Use of larger-diameter wire, however, results in a smaller surface-to volume-ratio, and therefore in higher skin-effect losses.

At 100 kHz, harmonics are present in the current waveform that make the effective parasitic resistance even higher. One problem with typical winding configurations is that there is a relatively large increase in parasitic resistance as the operating frequency is increased.

Primary inductance of coupled inductor 241 was measured to be 0.55 $\mu$H, with secondary 243 shorted, at 100 kHz. This parasitic inductance—the leakage inductance of the primary winding—would be zero in the case of a perfectly coupled inductor. It is caused by primary magnetic flux that is not shared by the secondary. Leakage inductance causes overshoot-voltage problems for flyback converters.

At the end of time period $t_1$, just after MOS power switching transistor 246 turns off, the voltage on secondary winding 243 is clamped by high-voltage diode 248 to a voltage just above the capacitor voltage. If coupled inductor 241 has no leakage inductance, the primary voltage is clamped to a value of $V_2$/N. However, because of the leakage inductance, the voltage on primary 242 can rise to an arbitrarily high value as the current through MOS power switching transistor 246 decreases. The high voltage appears as the drain voltage $V_d$ of MOS power switching transistor 246. Transistors of this type are easily damaged by drain voltages that are in excess of a maximum rating. The voltage spike at the end of $t_1$ has thus presented a challenging problem for designers of flash-capacitor charge circuits. Various approaches to this problem are illustrated in U.S. Pat. No. 6,069,803, U.S. Pat. No. 5,880,943, and U.S. Pat. No. 5,485,361.

Figure 26:
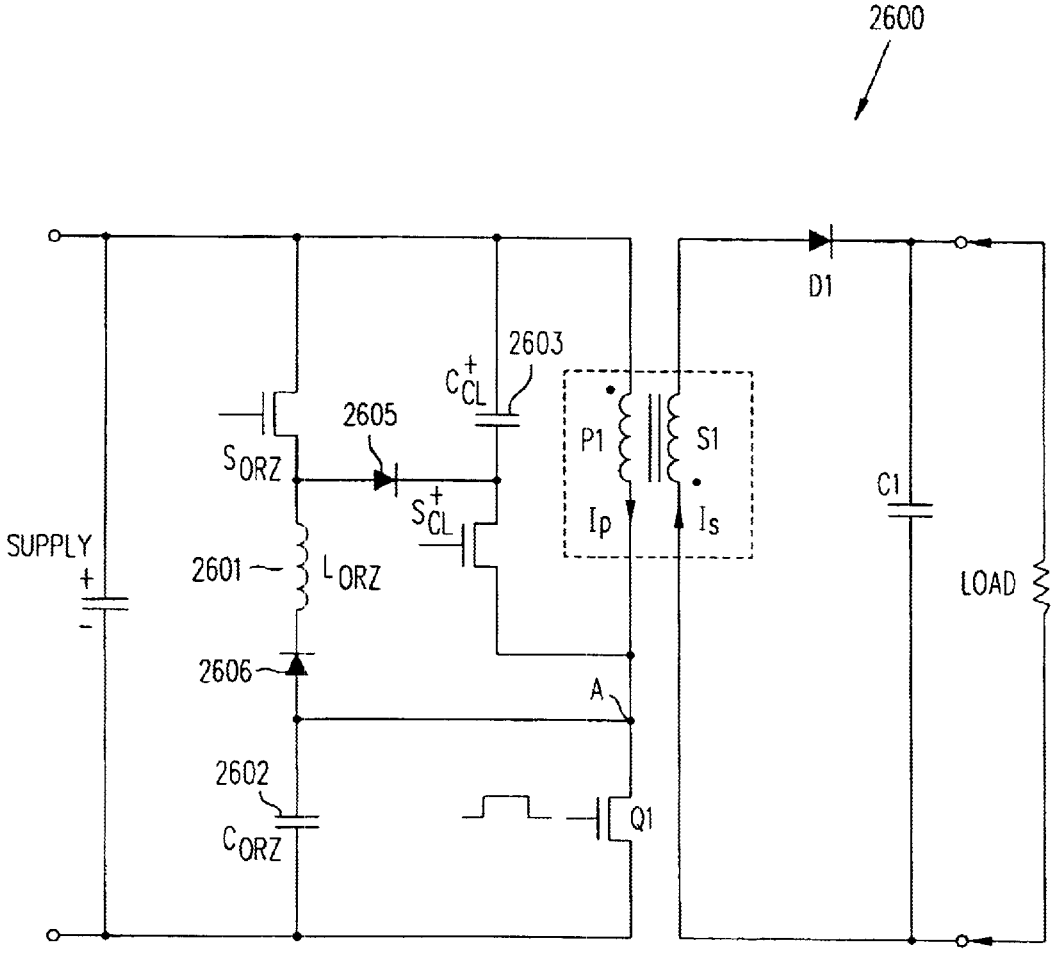
FIG. 26 PRIOR ART
FIG. 26 is FIG. 3 from U.S. Pat. No. 6,069,803, a schematic diagram of a prior-art flash charging circuit with a complex overshoot snubber.

FIG. 26 is FIG. 3 from U.S. Pat. No. 6,069,803. Circuit 2600 includes an active snubber circuit that consists of two MOS transistors with their associated driving circuitry (not shown in the figure)—inductor 2601, capacitors 2602 and 2603, and diodes 2605 and 2606—which address excess voltage. Circuits with active snubbers are complex and have critical timing requirements, so they are costly to manufacture. The remaining components in FIG. 26 are discussed in U.S. Pat. No. 6,069,803.

j. Drive Circuits

Figure 27:
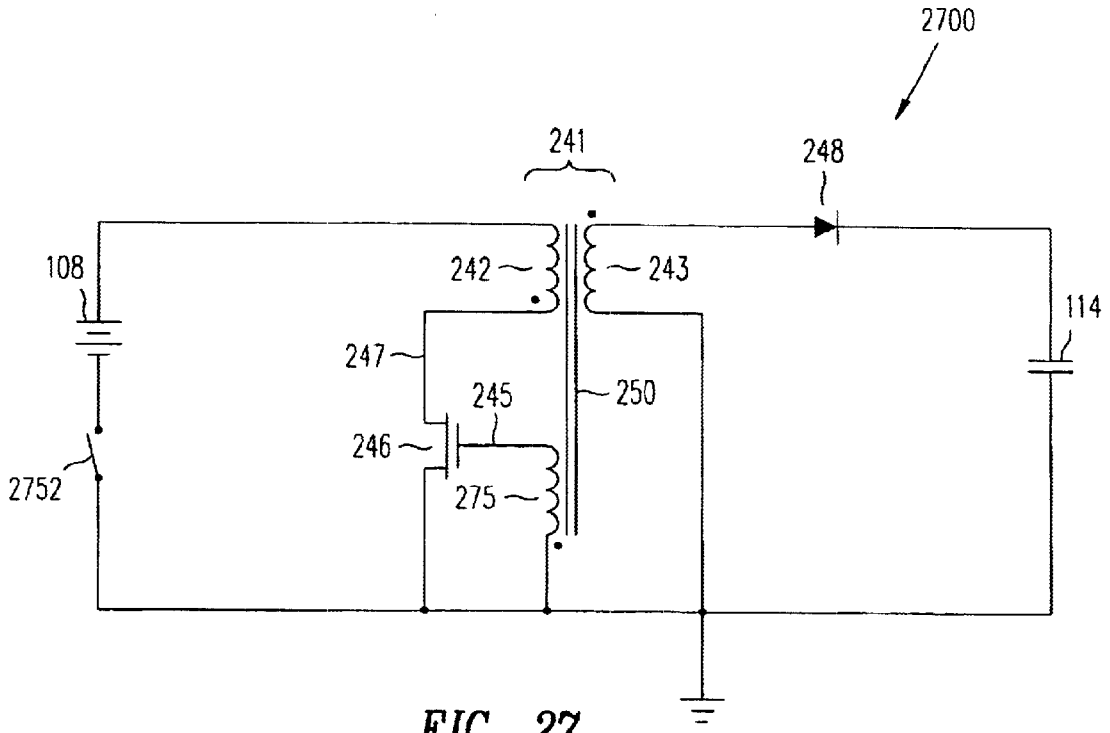
FIG. 27 is a schematic diagram of a self-excited drive circuit.

FIG. 27 is a schematic diagram of a typical self-excited drive circuit. Self-excited drive circuit 2700 is similar to circuit 200, but contains in addition switch 2752 and uses a modified coupled inductor 2741 that includes drive winding 2751 in addition to primary winding 2742 and secondary winding 2743 around core 2750. Many flash circuits use such a self-excited drive circuit, in which the drive voltage is derived from drive winding 2751; see, for example, U.S. Pat. No. 6,147,460, U.S. Pat. No. 6,091,906, U.S. Pat. No. 6,066,926, U.S. Pat. No. 5,966,552, U.S. Pat. No. 5,814,948, U.S. Pat. No. 5,781,804, U.S. Pat. No. 5,780,976, U.S. Pat. No. 5,282,120, U.S. Pat. No. 4,522,479, and U.S. Pat. No. 4,305,649.

Figure 28:
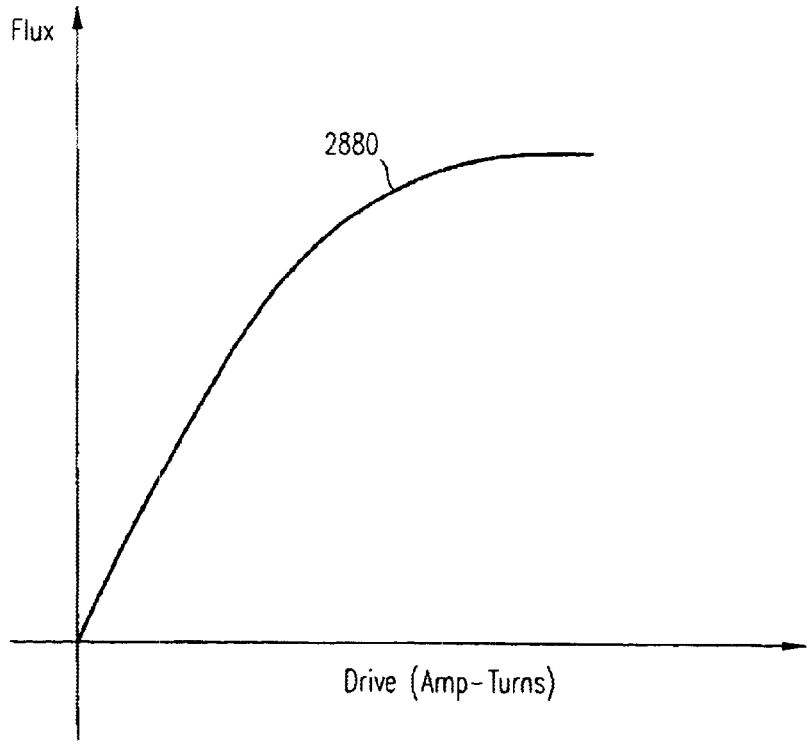
FIG. 28 is a graph of flux as a function of drive in a self-excited drive circuit.

FIG. 28 is a graph of a flux-versus-drive curve for circuit 2700, represented by curve 2880, the "B-H curve" for core 2750.

Figure 29:
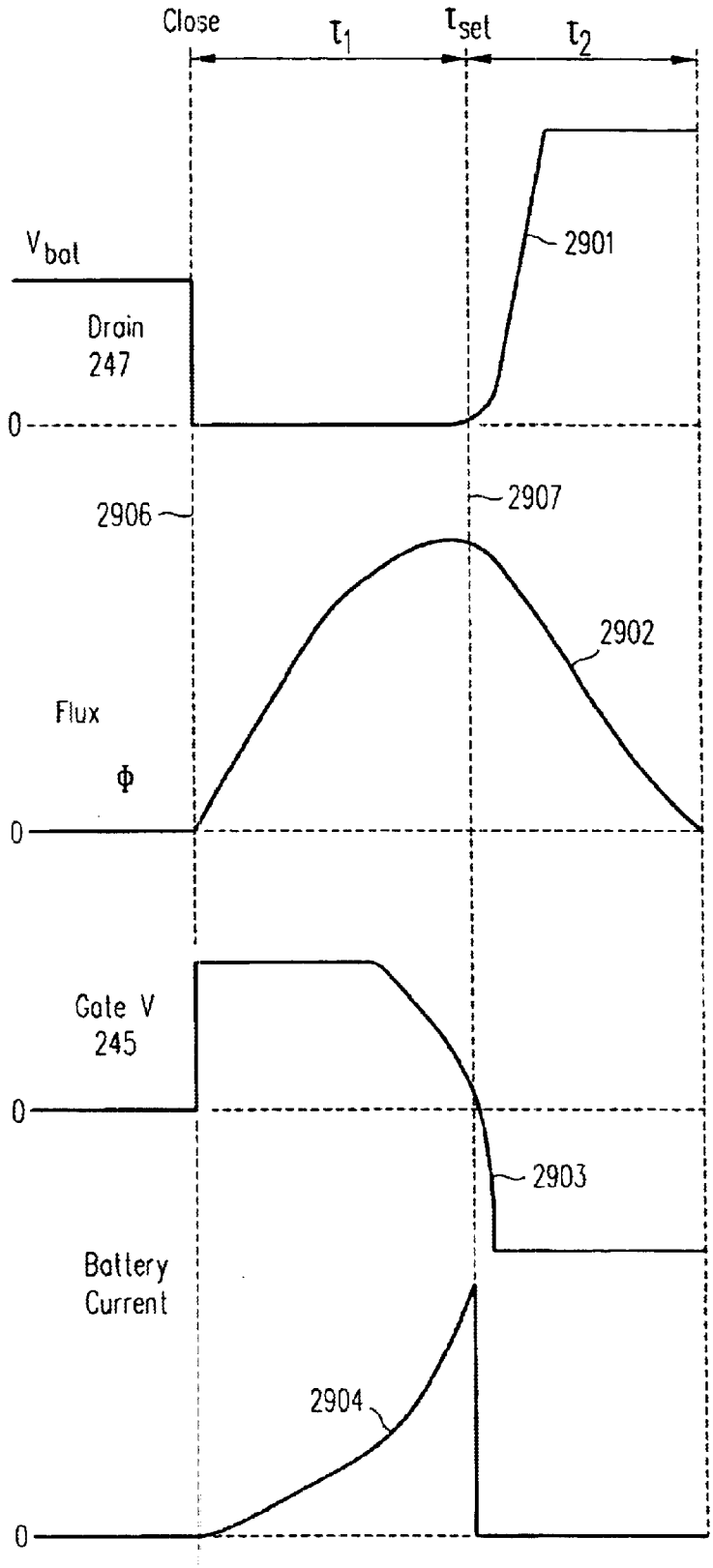
FIG. 29 is a timing diagram of the self-excited drive circuit of FIG. 27.

FIG. 29 is a timing diagram of the operation of self-excited drive circuit 2700. When switch 2752 is closed at $t_{close}$ (shown as time marker 2906), residual sub-threshold conduction in MOS power switching transistor 246 causes the battery voltage to be applied to primary winding 2742. The drain voltage of transistor 246 is represented by trace 2901. This increase in primary voltage is transmitted immediately to drive winding 2751, which further turns on MOS power switching transistor 246. Flux $\Phi$ in core 2750, shown as trace 2902, rises with time, as does current drained from battery 108, shown as trace 2904. Voltage at gate 245, shown as trace 2903, is derived from drive winding 2751, and is proportional to the time derivative of flux $\Phi$, keeping MOS power switching transistor 246 in its on state as long as the flux is rising uniformly.

As flux $\Phi$ approaches saturation at $t_{sat}$, (shown as time marking 2907), its time derivative decreases. Gate voltage 245 on MOS power switching transistor 246 begins to decrease as well. MOS power switching transistor 246 begins to reduce the voltage across primary winding 2742, causing drain voltage $V_d$ (shown as trace 2901) to rise above $V_{bat}$. Positive feedback turns off MOS power switching transistor 246. Capacitor 114 begins to charge at the start of time period $t_2$, draining energy from core 2750. The cycle then repeats.

A self-excited flyback converter may be advantageous because it is self-regulating. On-time $t_1$ is derived directly from the maximum energy-storage capability of core 2750 and from the battery voltage. Off-time $t_2$ is derived directly from the energy stored in core 2750, and from capacitor voltage. Circuit 2700 charges capacitor 114 as fast as battery 108 and core 2750 will permit. Operation can be robust against variations in the properties of components. These attributes make self-excited flyback-converter circuits attractive for use in low-cost camera systems.

Despite some possible advantages, self-excited flyback-converter circuits are inefficient. Because core 2750 is driven into saturation at the end of time period $t_1$, the inductance of primary winding 2742 is greatly reduced, and a great deal of current is drawn from battery 108 that does not result in energy stored in core 2750. The effect of saturation is illustrated by battery-current waveform 2904, in FIG. 29. The energy wasted during this brief period is typically more than one-half of the total energy removed from the battery. An additional source of energy loss is hysteresis in core 2750 when the latter is driven into saturation. Because of these and other energy-loss mechanisms, charge circuits supplied in some low-cost cameras are less than 25% efficient.

Efficiency problems in self-excited flyback-converter circuits may be mitigated by use of drive circuits that are not based on a voltage generated by an auxiliary winding on coupled inductor 2741. Such separately excited flyback-converter circuits are described in U.S. Pat. No. 6,219,493, U.S. Pat. No. 6,130,528, U.S. Pat. No. 5,498,951, U.S. Pat. No. 5,430,405, U.S. Pat. No. 4,070,699, and U.S. Pat. No. 4,027,199. Although some separately excited flyback-converter circuits may show efficiency improved over that of over self-excited circuits, they are typically less than 30% efficient.

Figure 5:
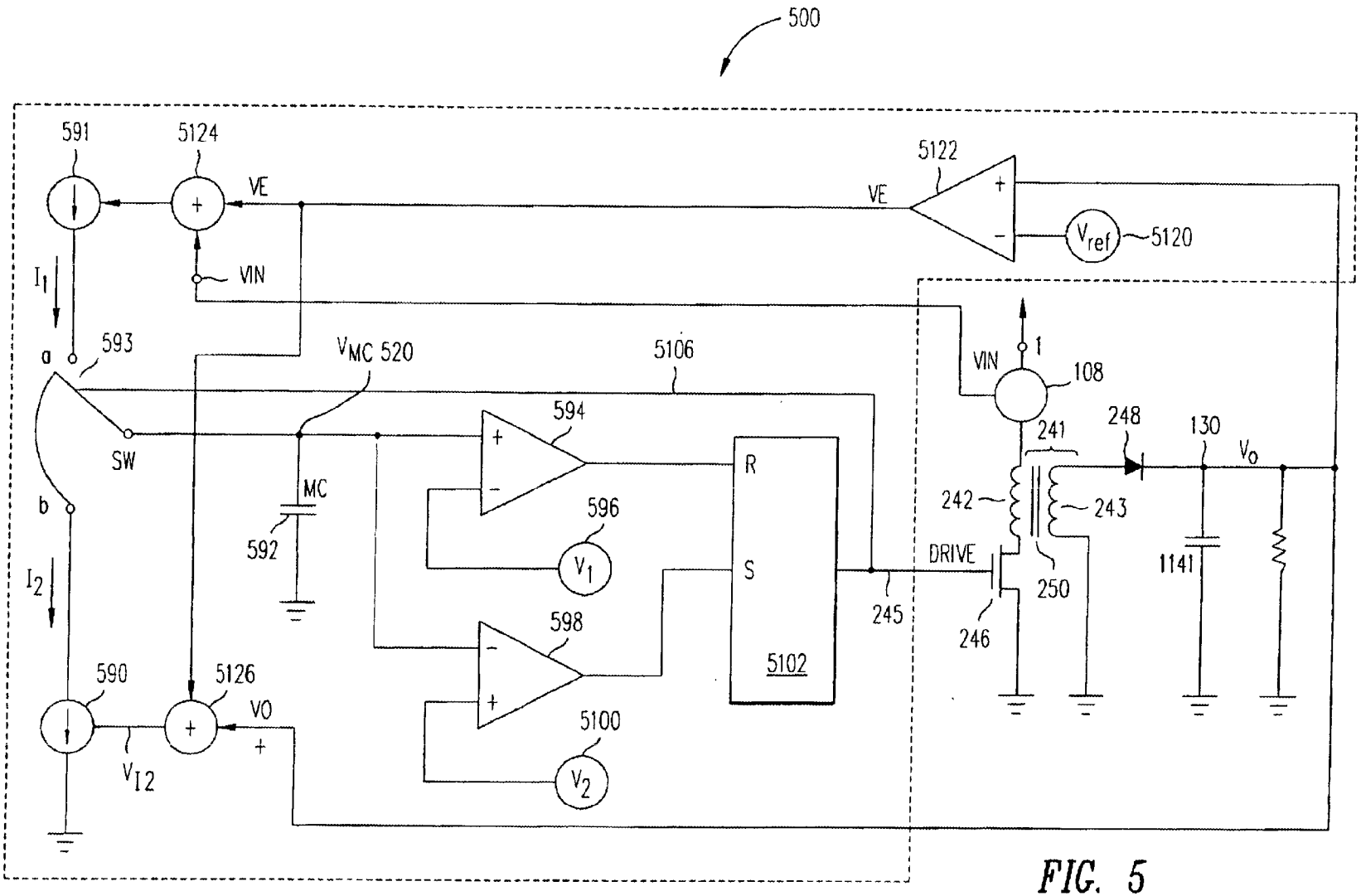
FIG. 5 PRIOR ART
FIG. 5 is FIG. 5 from U.S. Pat. No. 5,430,405, a schematic diagram of a prior-art photoflash charging circuit.

FIG. 5 is FIG. 5 from U.S. Pat. No. 5,430,405. Circuit 500 is an example of a separately excited flyback converter. Gate 245 of MOS power switching transistor 246 is controlled by bi-stable set-reset flip-flop 5102. When flip-flop output 5106 is high, MOS power switching transistor 246 connects primary winding 242 to ground. Flux Φ increases linearly with time at a rate proportional to source voltage $V_{in}$. Concurrently, switch 593, operated by output 5106, delivers current from current source 591 to model capacitor 592. This current causes voltage $V_{mc}$ on model capacitor 592 to increase linearly with time as well.

The value of current source 591 is made proportional to the value $V_{in}$ of a voltage source, for example, battery 108. Thus, the voltage on model capacitor 592 and the flux in the core of coupled inductor 241 both increase at a rate proportional to the source voltage $V_{in}$.

When the voltage on model capacitor 592, $V_{mc}$, reaches value $V_1$ (set by voltage source 596), a reset signal is sent by comparator 594 to flip-flop 5102. Flip-flop 5102 responds by setting to low output 5106, turning off MOS power switching transistor 246, and concurrently setting to its "b" position switch 593 and thus connecting capacitor 592 to second current source 590. Voltage $V_{mc}$ on model capacitor 592 decreases linearly with time as current flows into second current source 590, whereas flux Φ decreases linearly with time as flash capacitor 114 is charged.

The value of current source 590 is proportional to the output voltage $V_o$. Thus, the rate of decrease of flux Φ in core 250 and the rate of decrease of voltage $V_{mc}$ on model capacitor 592 are both proportional to output voltage $V_o$. When voltage $V_{mc}$ on model capacitor 592 reaches value $V_2$, set by voltage source 5100, a "set" signal is sent to flip-flop 5102. Flip-flop output 106 is driven high, MOS power switching transistor 246 turns on, switch 593 is set back to its "a" position, and the cycle repeats.

The voltage on model capacitor 592 is an analog model of the flux in coupled inductor 241. Circuit 500 adjusts the on time and off time to extract energy from battery 108 optimally, and delivers that energy to a load (that is, to the flash capacitor), according to the values of battery 108 and output voltage $V_o$. When output voltage $V_o$ rises to required maximum value $V_{ref}$, set by reference voltage 5120, operational amplifier 5122 increases $V_E$. If switch 593 is in position "a", increased $V_E$ causes current from current source 591 to increase. The speed at which model capacitor 592 reaches a charge voltage greater than $V_1$ increases. Therefore, comparator 594 triggers a reset in flip-flop 5102 sooner, and the on time is shorter. If switch 593 is in the "b" position, increased $V_E$(subtracted at junction 5126) causes current source 590 to drain model capacitor 592 more slowly, making the off-time longer. Both of these conditions slow the rate at which charge is delivered to capacitor 114.

Separate-excitation controller circuit 500 enables energy to be converted from battery 108 to capacitor 114 at a rate consistent with the flux in coupled inductor 241 being kept below its saturation value. A safety factor for the on and off times can be set by scaling of current sources 590 and 591 with respect to voltages $V_o$ and $V_{in}$. The circuit is discussed further in U.S. Pat. No. 5,430,405.

k. Limitations of Drive Circuits

Drive circuit 500 of FIG. 5 adapts to both output and supply voltages. There are, however, limitations in circuit 500 that prevent it from controlling optimally the charging of photoflash capacitor 114 from battery 108. One such limitation is imposed by the nature of battery 108 itself. Because the generation of electrical energy within a battery is an electrochemical process, there is an upper limit to the current that can be drawn from the battery without seriously affecting battery life. This upper current limit usually decreases as a battery becomes discharged. When circuit 500 is used to control the charging of photoflash capacitor 114, the off time, $t_{off}$, is shortened as capacitor voltage 130 ($V_o$) increases. The average current drawn from battery 108 depends on battery voltage $V_{bat}$ and on capacitor voltage $V_o$ according to Equation 40:

$$I_{av} = \frac{I_p}{2}\frac{t_{on}}{(t_{on}+t_{off})} \approx \frac{I_p}{2}\frac{V_o}{(V_o+NV_{bat})} \quad [40]$$

$I_p$ is the peak inductor current. The approximation derives from Equation 39, assuming that $t_{on}>t_1$ and $t_{off}>t_2$. If charge circuit 500 is able to charge the photoflash capacitor quickly from low voltages, when the discharge time of the secondary is long, it will draw too much current from the battery when the capacitor voltage is high and the off time is short.

In circuit 500 shown in FIG. 5, and in similar circuits (as in the above references), there is no protection of battery 108 from excessive current drain at high output voltages. This limitation has been sufficiently problematic that a recent approach to remedy it (described in U.S. Pat. No. 6,219,493) has been the incorporation of a microprocessor in a drive circuit. Such a remedy is complex, requiring several analog-to-digital conversions for its implementation.

Another limitation of circuit 500 is that operational amplifier 5122 has an input connected to output voltage $V_o$. In the days when vacuum tubes were in common use, it would not have been unreasonable to have an input connected to a 350 V signal. However, circuits that can withstand such voltages are expensive to construct with modern technologies. Circuit 500 also requires reference-voltage source 5120 to have the same voltage $V_{ref}$ as the desired maximum value of charge voltage $V_o$, and to comprise at least one additional reference voltage 596 for its proper operation. Both of these requirements make circuit 500 complex and expensive for portable, battery-powered photoflash systems. Although each of the above-discussed circuits may have certain advantages, none appears to satisfy all the requirements of a high-efficiency battery-powered photographic flash unit.

What is claimed is:

1. A photographic flash, comprising:

a flash tube filled with an ionizable gas;

a photoflash capacitor connected to supply energy to said flash tube;

a majority-carrier switching device, responsive to a control signal, connected to conduct current through said flash tube;

a trigger circuit, responsive to a trigger signal, connected to said flash tube; and a controller configured to send said trigger signal to said trigger circuit thereby to cause said gas in said flash tube to ionize, and configured to send said control signal to said majority-carrier switching device thereby to allow a flow of a current through said flash tube, thereby to initiate a flash discharge, and further configured to turn on and turn off said majority-carrier switching device a plurality of times while said gas in said flash tube remains ionized, thereby to cause a plurality of flash discharges.

2. The photographic flash of claim 1, wherein said controller is configured to turn off said majority-carrier switching device, thereby to terminate the flow of said current through said flash tube after a period of time, thereby to terminate said flash discharge.

3. The photographic flash of claim 2, wherein said controller comprises an interface for receiving commands from an exposure measurement system.

4. The photographic flash of claim 1, further comprising a charging circuit for charging said photoflash capacitor to a pre-determined voltage.

5. The photographic flash of claim 1, containing a series circuit comprising said photoflash capacitor, said flash tube, and said majority-carrier switching device.

6. The photographic flash of claim 5, wherein said majority-carrier switching device comprises a MOS transistor having a source, a drain, and a gate, wherein said drain is connected to said flash tube, said source is connected in series with said photoflash capacitor in said series circuit, and said gate is connected to respond to said control signal from said controller.

7. A charging circuit for charging a photoflash capacitor, comprising:

a DC power source;

a coupled inductor, comprising:

a primary winding comprising a plurality of primary winding layers, said primary winding layers electrically connected in parallel; a secondary winding comprising a plurality of secondary winding layers, said secondary winding layers electrically connected in series; and a magnetic core;

wherein said primary winding layers and said secondary winding layers are alternately layered around said magnetic core;

a switching transistor connected to conduct from said DC power source a current through said primary winding;

a driving circuit for providing a control signal to turn said switching transistor on and off, thereby to start and stop said current through said primary winding, thereby generating a charging current in said secondary winding by induction; and a rectifier for charging said photoflash capacitor with said charging current.

8. The charging circuit of claim 7, wherein said primary winding layers are comprised of wire, said wire comprising a plurality of strands.

9. The charging circuit of claim 7, wherein said switching transistor comprises a gate, a source, and a drain; said charging circuit containing a series circuit comprising said DC power source, said primary winding, said drain, and said source; and said gate is responsive to said control signal from said driving circuit.

10. The charging circuit of claim 7, containing a series circuit comprising said secondary winding, said rectifier, and said photoflash capacitor.

11. The charging circuit of claim 7, further comprising a smoothing circuit for smoothing the rate at which current is drained from said DC power source.

12. The charging circuit of claim 11, wherein said smoothing circuit comprises an inductive-capacitive filter.

13. The charging circuit of claim 12, wherein said inductive-capacitive filter comprises a filter inductor between said DC power source and said primary winding and a filter capacitor, and wherein said charging circuit contains a series circuit comprising said filter capacitor, said filter inductor, and said DC power source.

14. The charging circuit of claim 7, wherein said DC power source comprises a battery.

15. The charging circuit of claim 7, wherein said primary winding of said coupled inductor has a leakage inductance which is capable of producing an inductive overshoot voltage across said switching transistor, and said charging circuit further comprises a damping circuit for decreasing said inductive overshoot voltage.

16. The charging circuit of claim 15, wherein said damping circuit comprises a damping resistor and a damping capacitor, and containing a series circuit comprising said damping resistor, said damping capacitor, and said primary winding.

17. The charging circuit of claim 15, wherein said damping circuit comprises a damping inductor connected to hold said switching transistor in a partially-on state after said driving circuit has switched said control signal to turn said switching transistor off and until said current through said primary winding decreases to substantially zero.

18. The charging circuit of claim 17, wherein said damping inductor has an inductance approximately equal to said leakage inductance multiplied by the ratio of the on voltage of said switching transistor to a maximum allowable value of said inductive overshoot voltage across said switching transistor.

19. The charging circuit of claim 17, wherein said switching transistor comprises a gate, a source, and a drain; said drain is connected to said primary winding, and said damping inductor is connected to said source.

20. The charging circuit of claim 7, further comprising a quick-start circuit for charging said photoflash capacitor to a quick-start voltage, prior to charging with said charging current, said quick-start circuit comprising a resistor and a diode in series between said DC power source and said photoflash capacitor.

21. The charging circuit of claim 20, wherein said primary winding has a leakage inductance capable of producing an overshoot voltage across said switching transistor, and said charging circuit further comprises a damping circuit for decreasing said overshoot voltage, and said charging circuit further comprises a smoothing circuit for smoothing the rate at which current is drained from said DC power source.

22. The charging circuit of claim 21, wherein said DC power source comprises a battery.

23. A driving circuit for providing an on-off control signal for controlling a charging circuit for charging a photoflash capacitor, wherein said charging circuit comprises a DC power source, an inductor having a primary winding, and a switching transistor operative to turn on and turn off a primary current through said primary winding; and wherein said driving circuit comprises:

a DC voltage input from said DC power source of said charging circuit;

a charge-state input, representing a voltage on said photoflash capacitor;

a model capacitor having a model voltage;

a first current source, configured to charge said model capacitor in a first direction, said first current source capable of producing a first model current substantially in proportion to said charge-state input when said charge-state input is below a first threshold, increasing said first model current less than proportionately to said charge-state input when said charge-state input is above said first threshold and below a second threshold, and producing a substantially zero value of said first model current when said charge-state input is above said second threshold;

a second current source, configured to charge said model capacitor in a second direction, said second current source capable of producing a second model current proportional to said DC voltage input;

a bistable controller having an on state and an off state; and an electronic switch circuit for connecting said model capacitor alternately to said first current source when said bistable controller is in said off state and to said second current source when said bistable controller is in said on state, such that said first and second model currents charge said model capacitor alternately in opposite directions at rates determined by said charge-state input and said DC voltage input, respectively;

wherein said bistable controller is responsive to said model voltage, such that said on state is entered when said model voltage reaches a first reference voltage, and such that said off state is entered when said model voltage reaches a second reference voltage, said bistable controller thereby capable of effecting a cyclic on-off action and producing said on-off control signal as its output; and wherein said on-off control signal has an on level when said bistable controller is in said on state and an off level when said bistable controller is in said off state, said on level operative to control said switching transistor of said charging circuit to turn on said primary current, and said off level operative to control said switching transistor of said charging circuit to turn off said primary current.

24. The driving circuit of claim 23, wherein said on state has a duration substantially inversely proportional to said DC voltage input.

25. The driving circuit of claim 24, wherein said off state has a duration substantially inversely proportional to said charge-state input while said charge-state input is less than said first threshold.

26. The driving circuit of claim 25, wherein said off state has a duration that decreases less than inversely proportionally to said charge-state input when said charge-state input is greater than said first threshold and less than said second threshold.

27. The driving circuit of claim 26, wherein said cyclic on-off action stops with said bistable controller in said off state when said charge-state input is greater than said second threshold.

28. The driving circuit of claim 26, wherein said DC power source comprises a battery having a maximum safe current rating, and the rate of said cyclic on-off action does not exceed that rate at which a current equal to said maximum safe current rating would be drawn from said battery.

29. The driving circuit of claim 23, further comprising at least one voltage reference circuit comprising a solid-state voltage reference element, said at least one voltage reference circuit configured to generate said first reference voltage and said second reference voltage.

30. The driving circuit of claim 23, wherein said first and second current sources comprise transistors biased in saturation.

31. The driving circuit of claim 23, wherein said charge-state input comprises a current input, such that said charge-state input can be supplied by a voltage-dropping resistor, said voltage-dropping resistor connected between said charge-state input and said photoflash capacitor.

32. A charging circuit for charging a photoflash capacitor, comprising:

a DC power source;

a coupled inductor, comprising:

a primary winding comprising a plurality of primary winding layers, said primary winding layers electrically connected in parallel;

a secondary winding comprising a plurality of secondary winding layers, said secondary winding layers electrically connected in series; and a magnetic core;

wherein said primary winding layers and said secondary winding layers are alternately layered around said magnetic core;

a switching transistor operative to turn on and turn off a primary current through said primary winding, thereby generating a charging current in said secondary winding by induction;

a rectifier for charging said photoflash capacitor with said charging current; and a driving circuit for controlling said switching transistor, wherein said driving circuit comprises:

a DC voltage input from said DC power source;

a charge-state input, representing a voltage on said photoflash capacitor;

a model capacitor having a model voltage;

a first current source, configured to charge said model capacitor in a first direction, said first current source capable of producing a first model current substantially in proportion to said charge-state input when said charge-state input is below a first threshold, increasing said first model current less than proportionately to said charge-state input when said charge-state input is above said first threshold and below a second threshold, and producing a substantially zero value of said first model current when said charge-state input is above said second threshold;

a second current source, configured to charge said model capacitor in a second direction, said second current source capable of producing a second model current proportional to said DC voltage input;

a bistable controller having an on state and an off state; and an electronic switch circuit for connecting said model capacitor alternately to said first current source when said bistable controller is in said off state and to said second current source when said bistable controller is in said on state, such that said first and second model currents charge said model capacitor alternately in opposite directions at rates determined by said charge-state input and said DC voltage input, respectively;

said bistable controller being responsive to said model voltage, such that said on state is entered when said model voltage reaches a first reference voltage, and such that said off state is entered when said model voltage reaches a second reference voltage, said bistable controller thereby capable of effecting a cyclic on-off action; and wherein said bistable controller is operative to control said switching transistor to turn on said primary current when said bistable controller is in said on state, and to turn off said primary current when said bistable controller is in said off state.

33. The charging circuit of claim 32, wherein said DC power source comprises a battery.

34. The charging circuit of claim 32, wherein said on state has a duration substantially inversely proportional to said DC voltage input.

35. The charging circuit of claim 34, wherein said off state has a duration substantially inversely proportional to said charge-state input while said charge-state input is less than said first threshold.

36. The charging circuit of claim 35, wherein said off state has a duration that decreases less than inversely proportionally to said charge-state input when said charge-state input is greater than said first threshold and less than said second threshold.

37. The charging circuit of claim 36, wherein said DC power source comprises a battery having a maximum safe current rating, and the rate of said cyclic on-off action does not exceed that rate at which a current equal to said maximum safe current rating would be drawn from said battery.

38. The charging circuit of claim 36, wherein said cyclic on-off action stops with said bistable controller in said off state when said charge-state input is greater than said second threshold.

39. The driving circuit of claim 38, wherein said charge-state input comprises a current through a voltage-dropping resistor, said voltage-dropping resistor connected to said photoflash capacitor.

* * * * *